US009328540B2

(12) United States Patent
Yokomori et al.

(10) Patent No.: US 9,328,540 B2
(45) Date of Patent: May 3, 2016

(54) VEHICLE DOOR LATCH SYSTEM

(71) Applicant: MITSUI KINZOKU ACT CORPORATION, Yokohama-shi (JP)

(72) Inventors: Kazuhito Yokomori, Yokohama (JP); Kohei Yamashita, Yokohama (JP)

(73) Assignee: MITSUI KINZOKU ACT CORPORATION (JP)

( * ) Notice: Subject to any disclaimer, the term of this patent is extended or adjusted under 35 U.S.C. 154(b) by 255 days.

(21) Appl. No.: 13/975,921

(22) Filed: Aug. 26, 2013

(65) Prior Publication Data

US 2014/0062101 A1 Mar. 6, 2014

(30) Foreign Application Priority Data

Aug. 31, 2012 (JP) ..... 2012-191711

(51) Int. Cl.

| | |
|---|---|
| ***E05C 19/10*** | (2006.01) |
| ***E05B 81/04*** | (2014.01) |
| ***E05B 83/40*** | (2014.01) |

(52) U.S. Cl.

CPC ..... *E05B 81/04* (2013.01); *E05B 83/40* (2013.01); *Y10T 292/0949* (2015.04)

(58) Field of Classification Search

USPC ..... 292/100, 21

See application file for complete search history.

(56) References Cited

U.S. PATENT DOCUMENTS 5,232,253 A * 8/1993 Tamiya ..... E05B 81/20 292/201
7,434,853 B2 * 10/2008 Yamamoto et al. ..... E05B 81/14 292/201

FOREIGN PATENT DOCUMENTS

| | | |
|---|---|---|
| CN | 101105092 A | 1/2008 |
| JP | 2004-293038 | 10/2004 |
| JP | 2008-19568 | 1/2008 |

* cited by examiner

*Primary Examiner* — Mark Williams
(74) *Attorney, Agent, or Firm* — Ostrolenk Faber LLP

(57) ABSTRACT

In a vehicle, a striker engages with a latch which engages with a ratchet. A door of the vehicle is closed. A motion-transmitting path for transmitting power to the ratchet from an electric drive mechanism is provided. A release-canceling mechanism connects or cuts off the motion-transmitting path. When the ratchet is released from the latch, the door-cooperating lever cuts off the release-canceling mechanism to enable the ratchet to engage with the latch again. Hence the door is closed.

6 Claims, 23 Drawing Sheets

VEHICLE DOOR LATCH SYSTEM

BACKGROUND OF THE INVENTION

The present invention relates to a vehicle door latch system in which a latch mechanism is released by an electric drive mechanism to enable a door to open.

In JP2004-293038A, a vehicle door latch system comprises a latch mechanism which engages with a striker of a vehicle to hold a door closed; and an electric drive mechanism including a motor to provide a closing function for moving the latch mechanism from a half-latch state to a full-latch state by turning a rotary member by the electric drive mechanism and a releasing function for releasing the latch mechanism by turning the rotary member in another direction by the motor.

However, in the vehicle door latch system, during releasing motion in which the rotary member turns by the motor, electrical failures occurs and the rotary member is held by the releasing motion. Specifically, in the release-holding state, the latch mechanism is also held by the releasing motion. By operating a handle, the connection between the rotary member and the releasing function is canceled thereby enabling the latch mechanism to engage with the striker, so that the door can be closed. But the releasing function is likely to be invalidated by operating the handle, which is disadvantageous.

SUMMARY OF THE INVENTION

In view of the disadvantages in the prior art, it is an object of the present invention to provide a vehicle door latch system enabling a release-holding state to be canceled without special operation by a passenger.

BRIEF DESCRIPTION OF THE DRAWINGS

The above and other features and advantages of the present invention will be apparent from the following detailed description with respect to the accompanying drawings.

DETAILED DESCRIPTION OF PREFERRED EMBODIMENTS

One embodiment of the present invention will be described with respect to drawings. In the following description, the left and right in FIGS. 1, 2, 8-15 are deemed as a rear and a front of a vehicle respectively.

Figure 1:
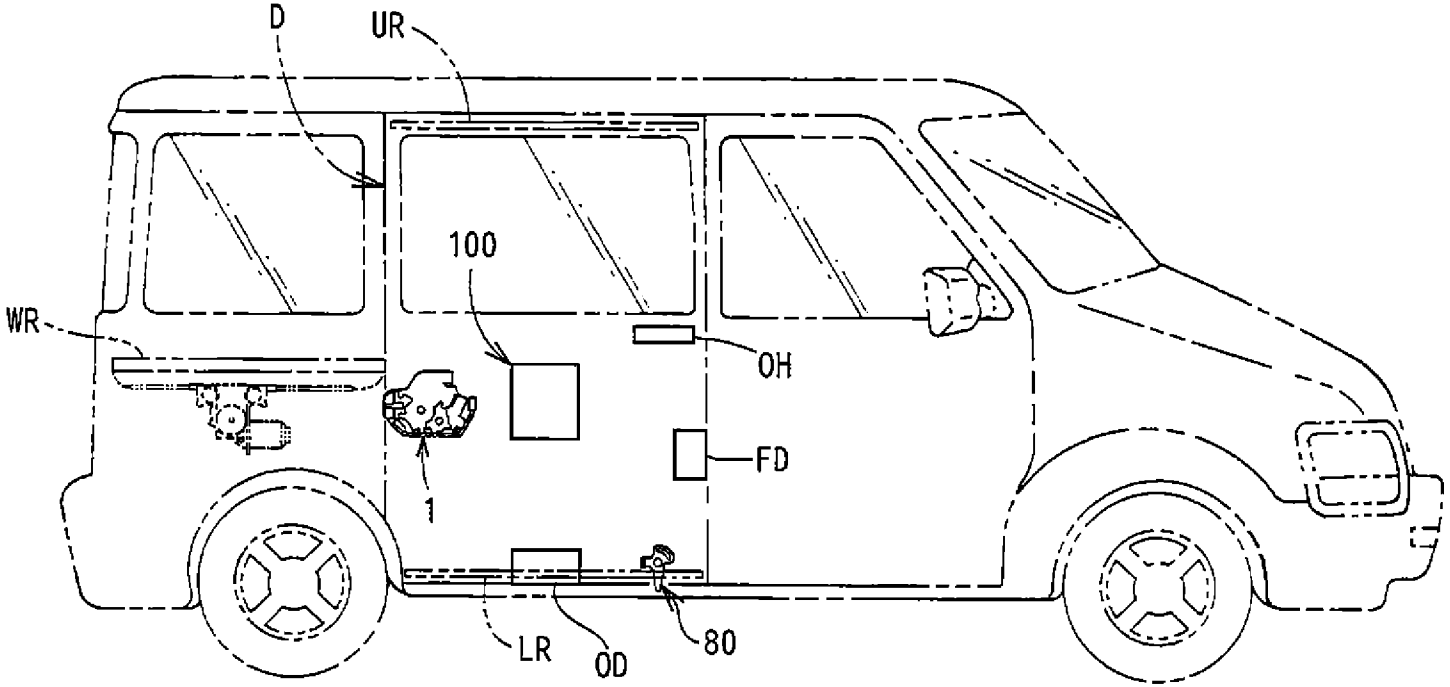
FIG. 1 is a schematic view of a vehicle to which a door latch system according to the present invention is applied.
Figure 2:
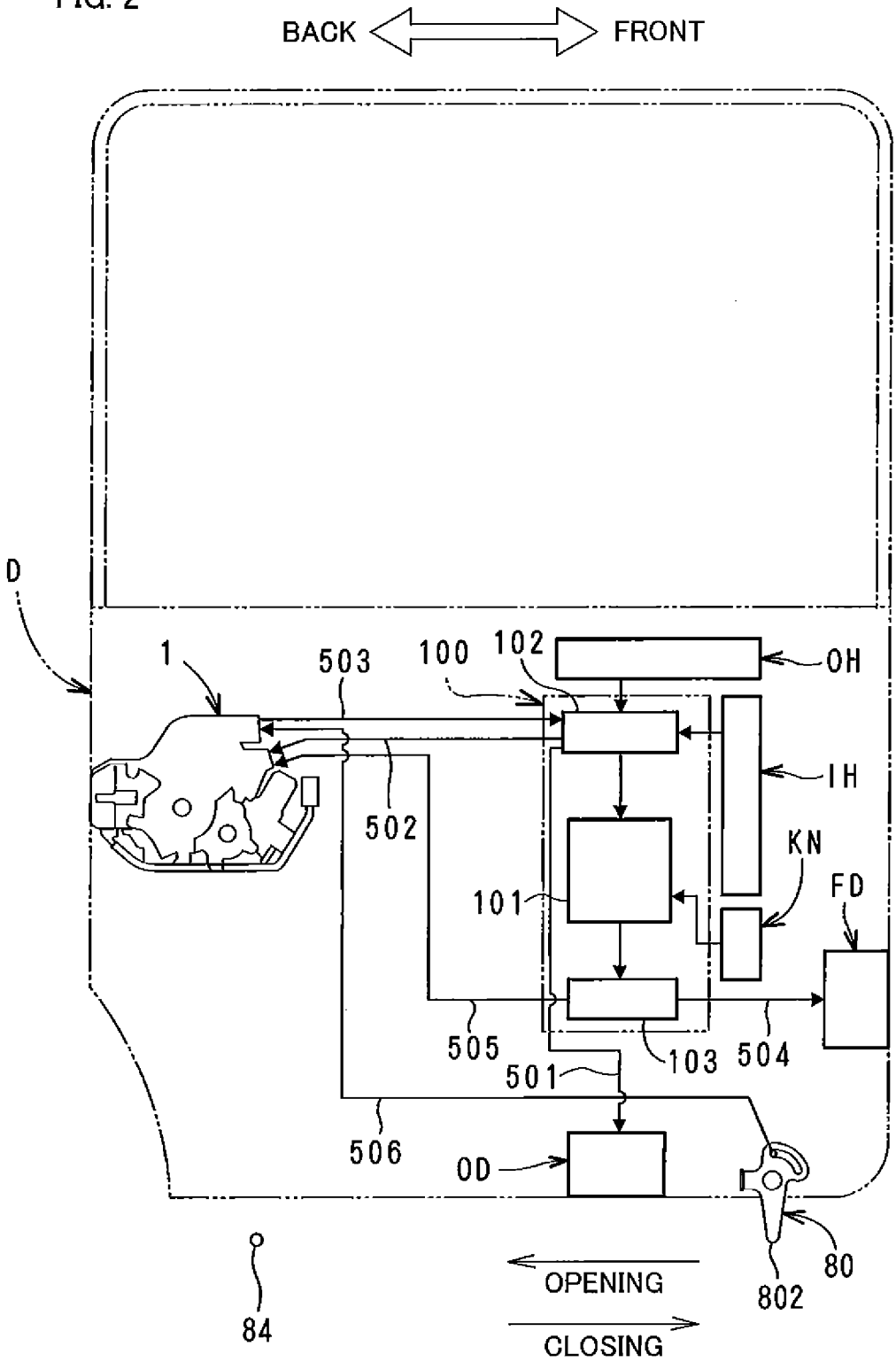
FIG. 2 is a schematic view of a sliding door.

In FIGS. 1 and 2, D denotes a sliding door which opens and closes back and forth along an upper guide rail UR, a waist guide rail WR and a lower guide rail LR at the side of a vehicle body. OH denotes an outside handle positioned on the outer panel of the door D and operated from the outside of the vehicle to get the door D to open and close; IH denotes an inside handle positioned on the door D inside the vehicle to get the door D to open and close; KN denotes a locking knob positioned on the door D inside the vehicle and operated to change a locking mechanism 101 (later described) into a locking state and an unlocking state; FD denotes a front door latch positioned at the front end of the door D to hold the door D closed; OD denotes a fully-open door latch positioned at the lower end of the door D to hold the door D in a fully-open position; 1 denotes a door latch positioned at the lower part of the door D to hold the door D closed with the front door latch; 100 denotes a motion-connecting section positioned inside the door D to connect and control a motion of the outside handle OH and inside handle IH to transmit the motion to the door latch 1, front door latch FD and fully-open door latch OD; and 80 denotes a door-cooperating lever at the lower end of the door D.

In this embodiment, the door latch 1, the door-cooperating lever 80 and motion-connecting section 100 are disposed in the door D, but the present invention is not limited thereto. The door latch 1, door-cooperating lever 80 and motion-connecting section 100 may be disposed in the vehicle body. In this case, a striker S (later described) which engages with the door latch 1 and a contact pin 84 which can make in contact with the door-cooperating lever 80 are disposed in the door D.

The motion-connecting section 100 comprises the locking mechanism 101 comprising a plurality of levers which can change between an unlocking state for enabling the door D to open by validating the outside handle OH and inside handle IH based on electric operation of a locking/unlocking electric actuator (not shown) and unlocking/locking operation of the locking knob KN manually operated by a passenger; a handle-connecting lever 102 always moving by the outside handle OH and inside handle IH regardless of the state of the locking mechanism 101; and an output lever 103 operated by the outside handle OH and inside handle IH only when the locking mechanism 101 is in the unlocking state.

The handle-connecting lever 102 is connected to the fully-open door latch OD and door latch 1 respectively via motion-transmitting members 501 and 502,503 such as a rod or a Bowden cable. The output lever 103 is connected to the front door latch FD and door latch 1 respectively via motion-transmitting members 504 and 505 such as a rod or a Bowden cable.

Figure 3:
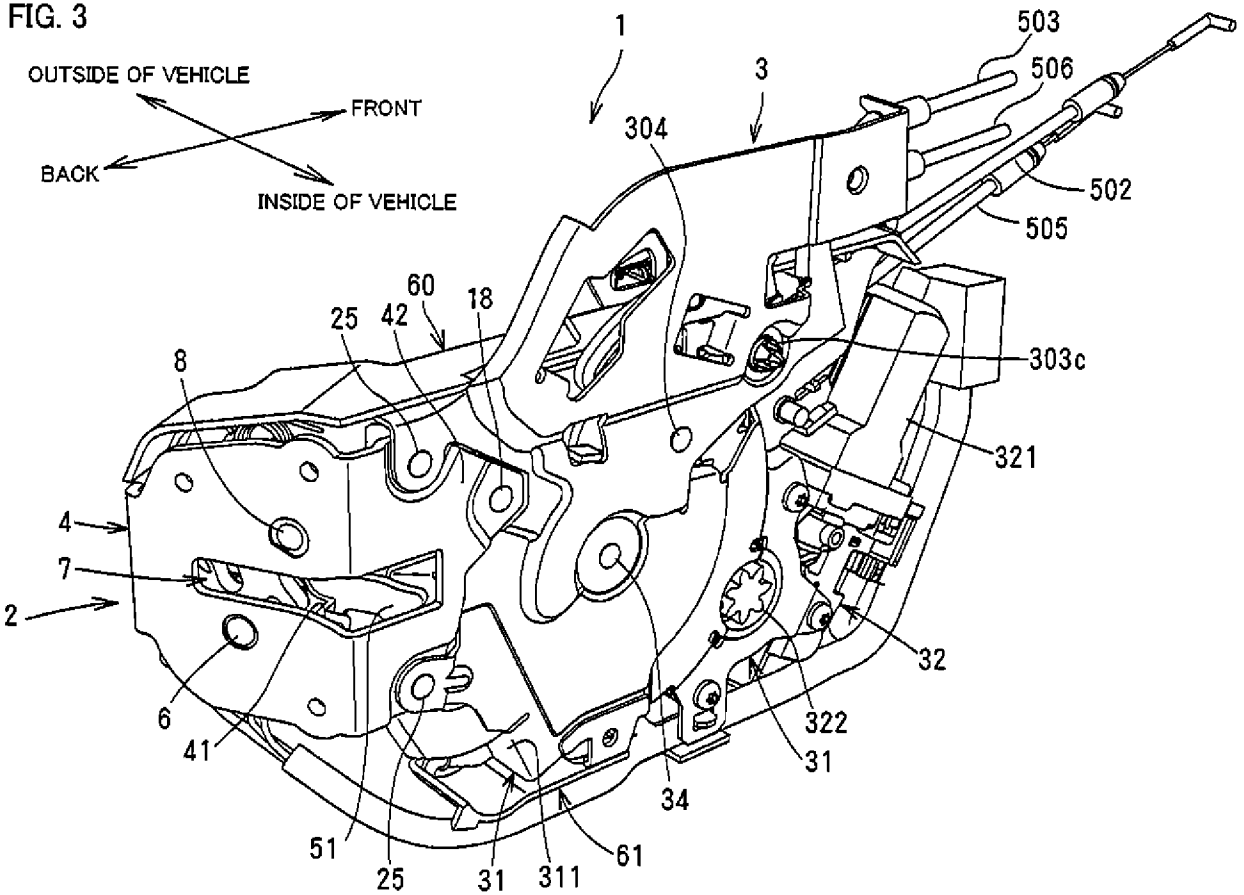
FIG. 3 is a perspective view of the door latch system seen from the inside of the vehicle.
Figure 4:
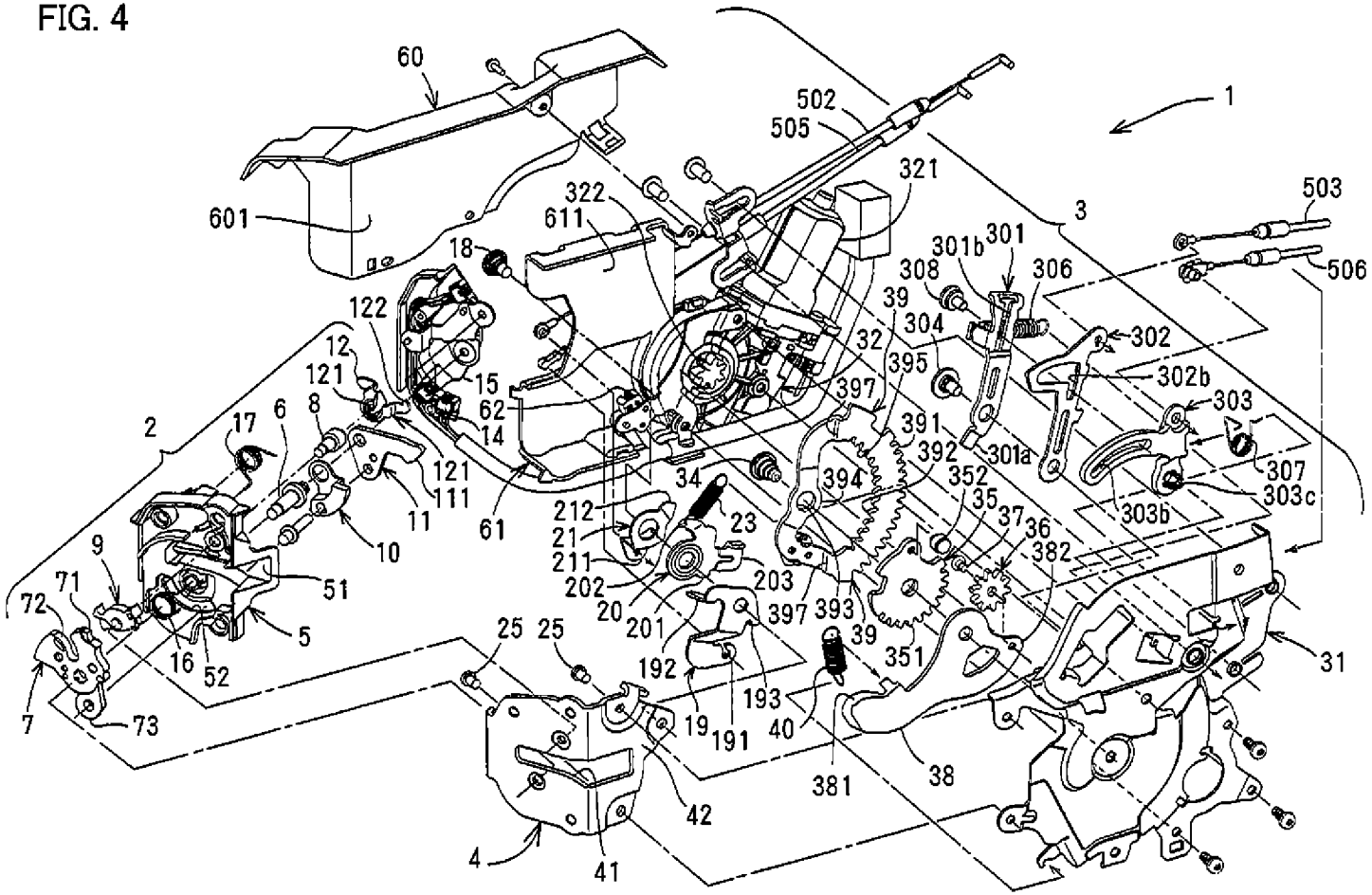
FIG. 4 is an exploded perspective view seen from the inside of the vehicle.
Figure 5:
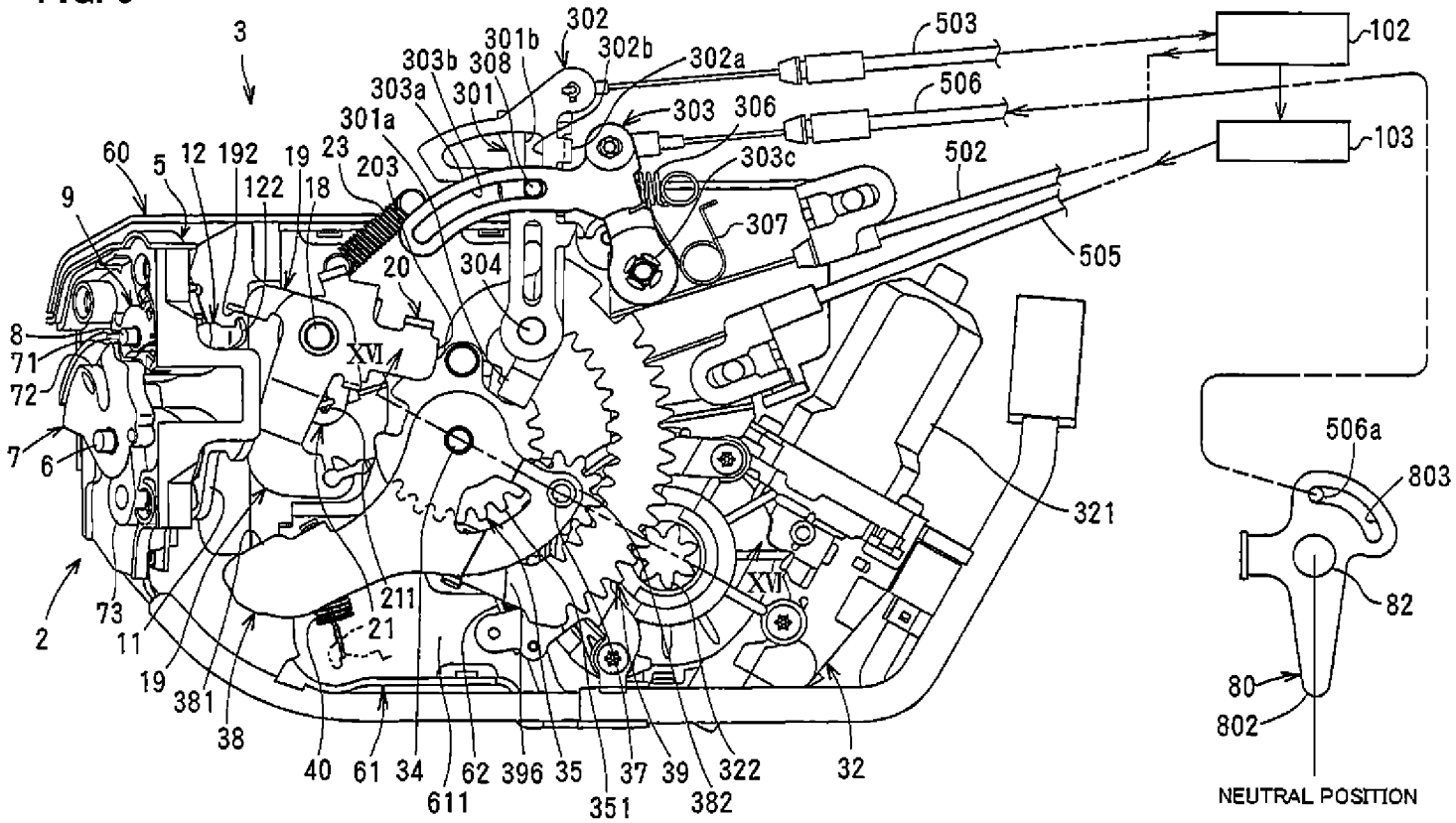
FIG. 5 is a front elevational view seen from the inside of the vehicle to clearly illustrate the inside of the door latch system.

In FIGS. 3-5, the door latch 1 comprises the latch unit 2 which engages with the striker (in FIG. 6) fixed to the vehicle body to hold the door D closed; and a closer-release unit 3 having closing function for moving the latch unit 2 from a half-latch state to a full-latch state to forcedly close the door D from a half-latch state (not-shut properly state) to a full-latch state (fully closed state); and a closer-release unit 3 having a releasing function for disengaging the latch unit 2 from the striker S.

The door latch 1 is defined to effect at least the releasing function of the closing function and releasing function in addition the latch mechanism comprising a latch 7 and a ratchet 9.

The top of the latch unit 2 and closer-release unit 3 is covered with a synthetic-resin top cover 60 for preventing rain water and dust. The bottom of the closer-release unit 3 is covered with a synthetic-resin bottom cover 61 for preventing rain water and dust. The side of a planetary gear mechanism 33 of the closer-release unit 3 which faces the outside of the vehicle is covered with a side wall 601 of the top cover 60 and a side wall 611 of the bottom cover 61.

Then, the latch unit 2 will be described.

In FIGS. 3-7, the latch unit 2 comprises a synthetic-resin housing 5 in which a surface mounted to the door D is closed by an L-shaped metal cover plate 4. The housing 5 includes the latch mechanism comprising the latch 7 which is pivotally mounted via a latch shaft 6 extending longitudinally of the vehicle to engage with the striker S, and the ratchet 9 which is pivotally mounted via a ratchet shaft 8 extending longitudinally of the vehicle to selectively engage with a full-latch engagement portion 71 or a half-latch engagement portion 72 on the outer circumference of the latch 7. The cover plate 4 is omitted in FIG. 5 to clearly show the internal structure of the latch unit 2.

In the cover plate 4 and housing 5 of the latch unit 2, there are respectively formed striker-fitting grooves 41,51 which are open at the inner side so that the striker S may fit in the striker-fitting grooves 41,51 when the door D is closed.

Figure 6:
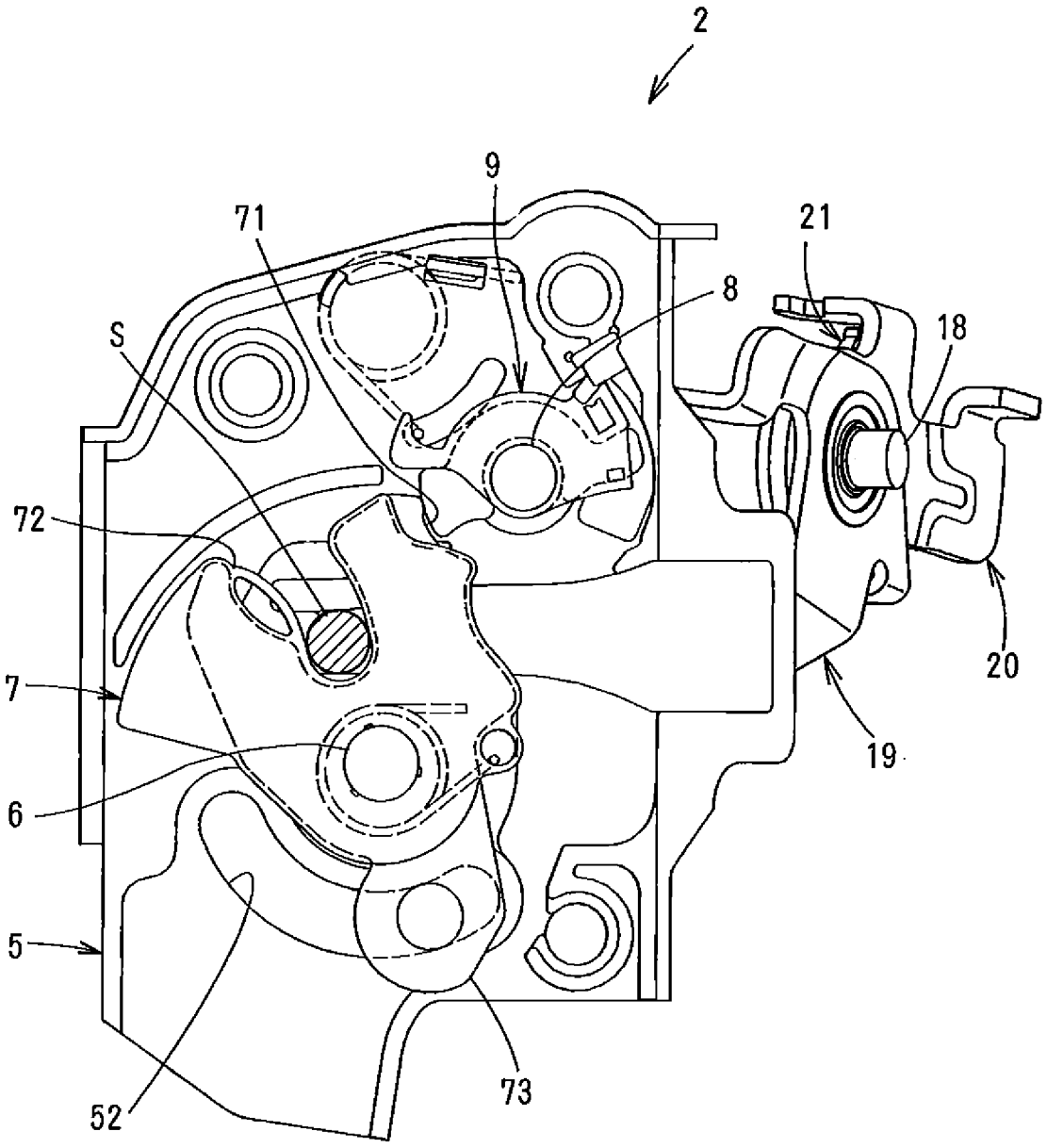
FIG. 6 is a side elevational view seen from the front to clearly illustrate the inside of a latch unit.
Figure 8:
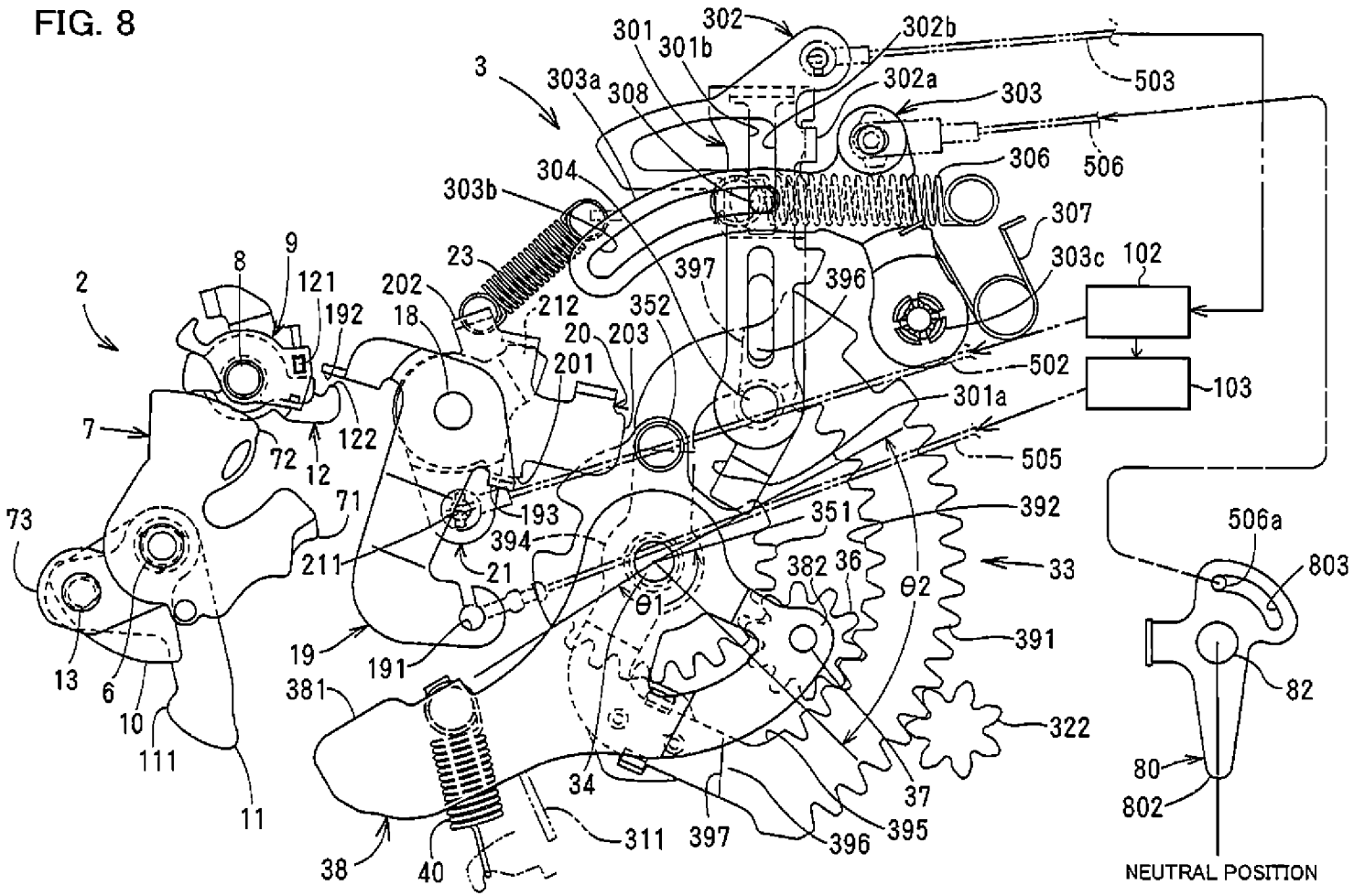
FIG. 8 is a front elevational view of the door latch system in an open state.
Figure 9:
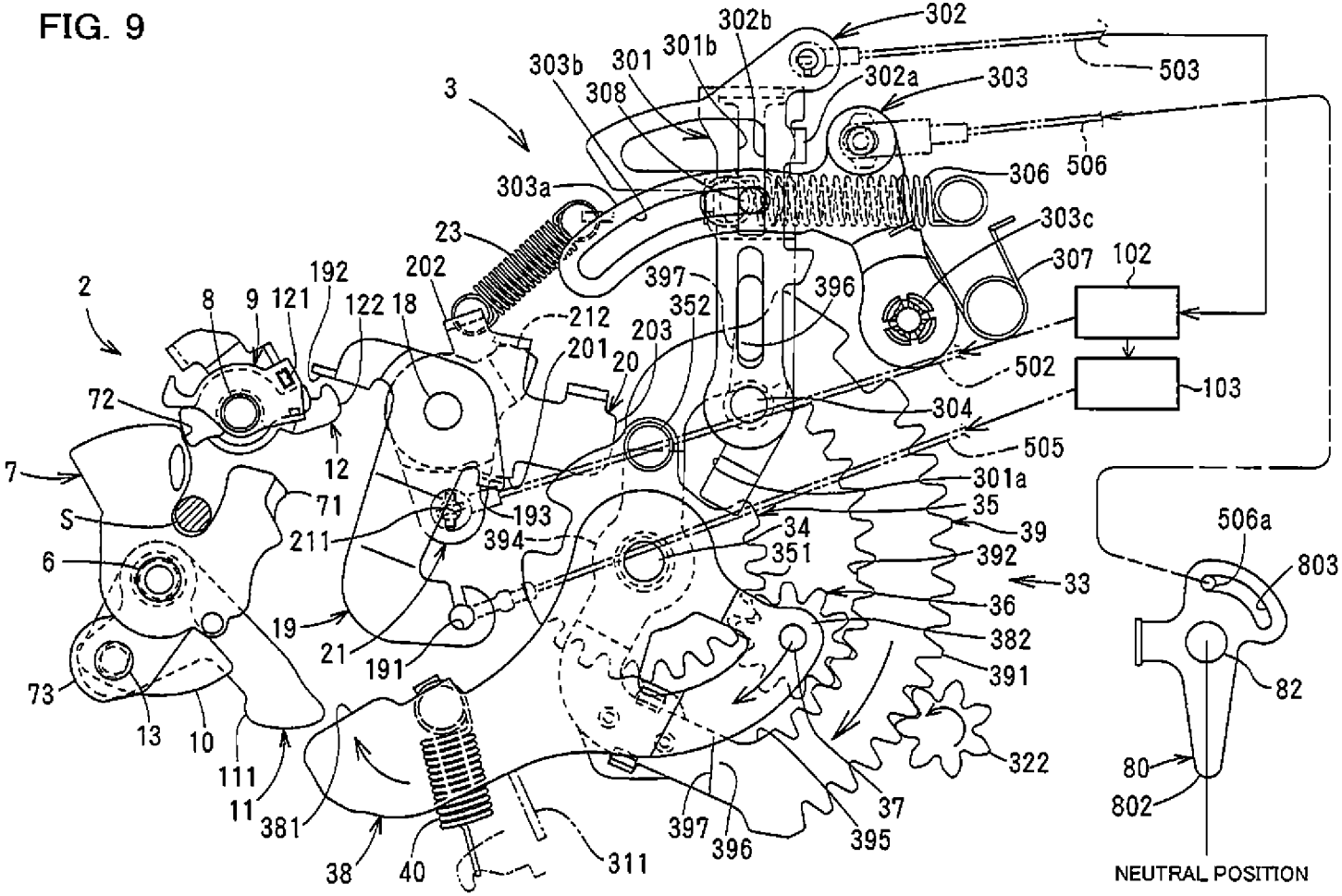
FIG. 9 is a front elevational view of the door latch system in a half-latch state.
Figure 10:
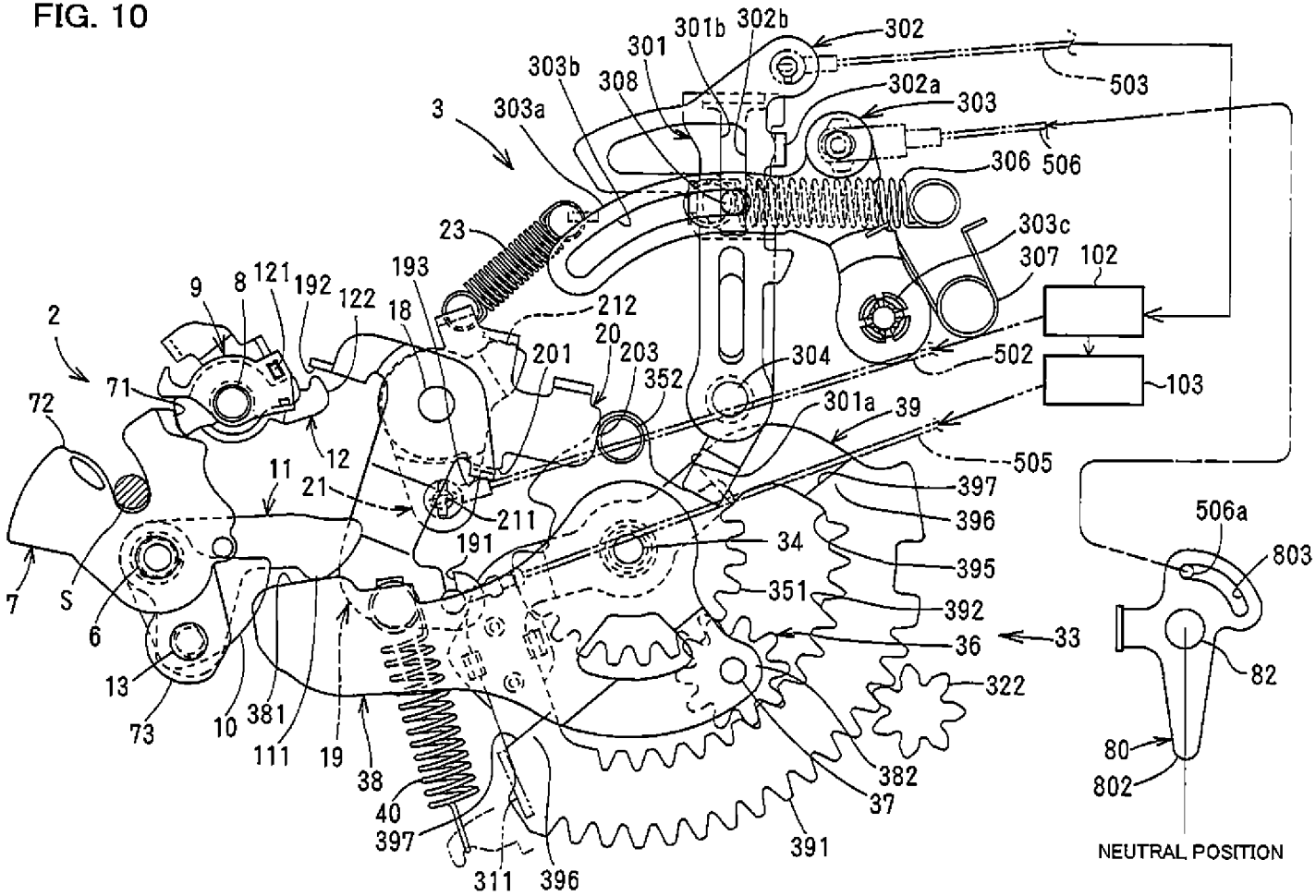
FIG. 10 is a front elevational view of the door latch system during a closing action.
Figure 11:
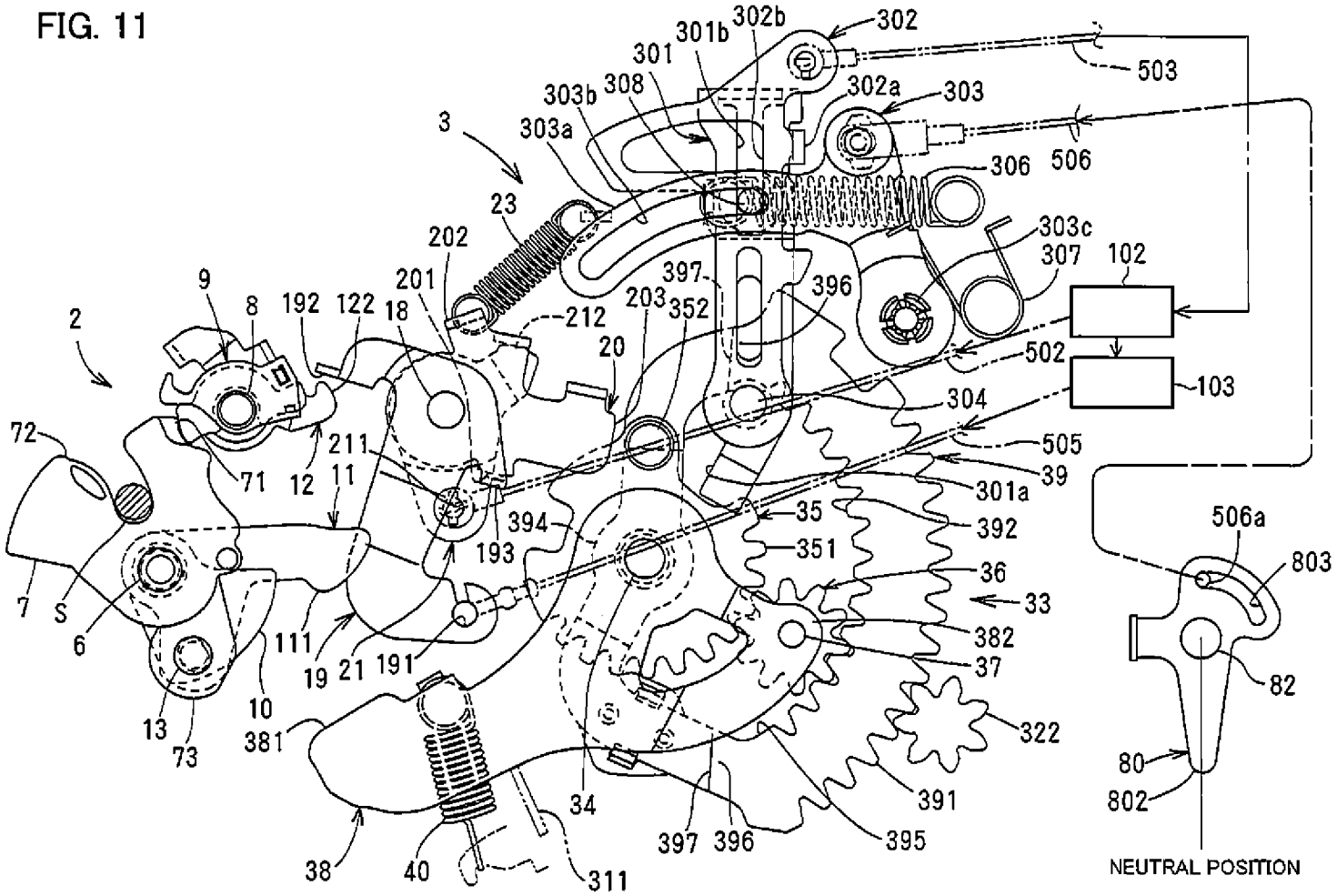
FIG. 11 is a front elevational view of the door latch system in a full-latch state.
Figure 12:
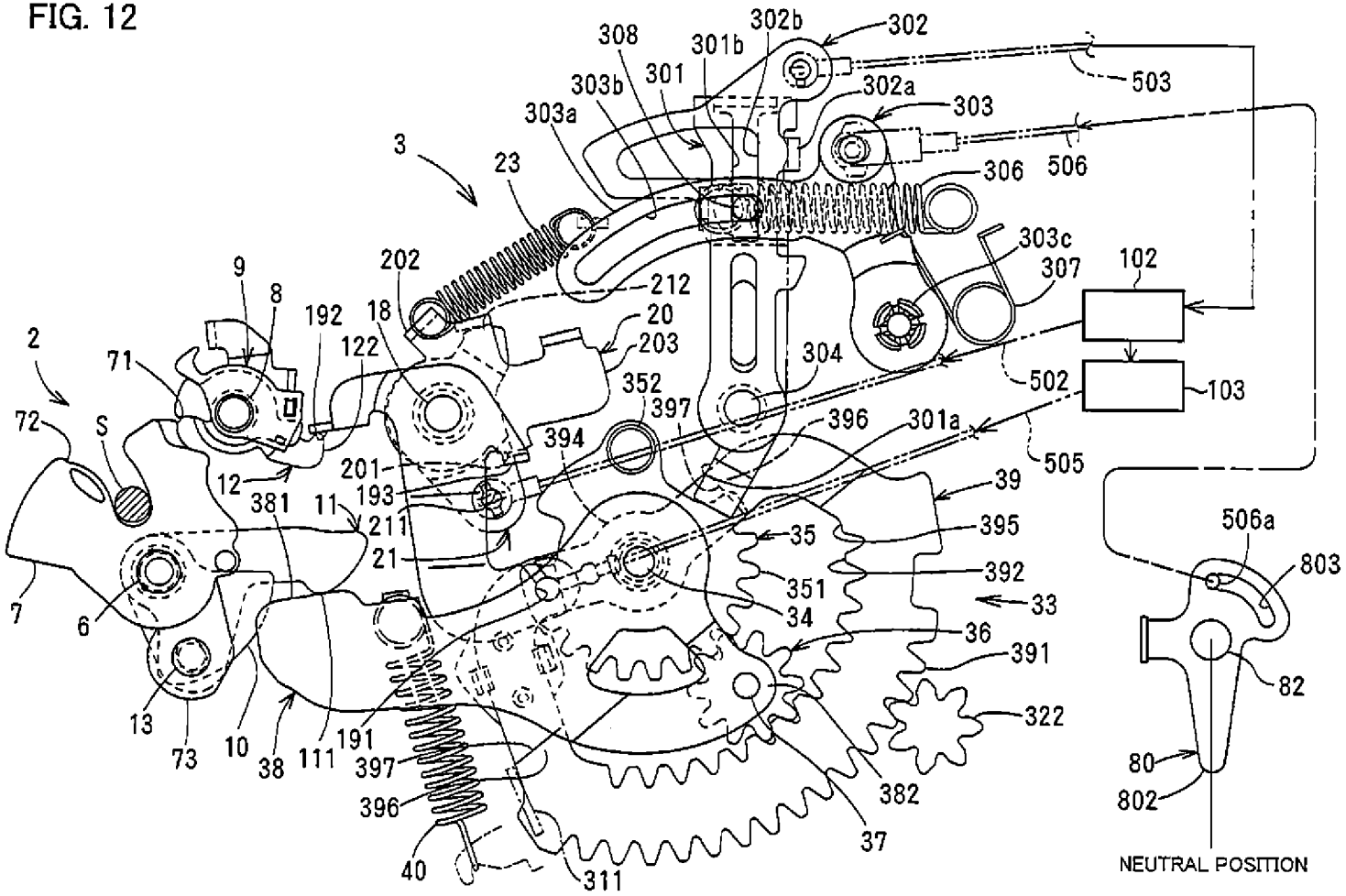
FIG. 12 is a front elevational view of the door latch system in which a closing action is canceled.

The latch 7 turns in a closing direction or counterclockwise in FIG. 8 against a force by a spring 16 (in FIG. 4) wound on the latch shaft 6, from an open position in FIG. 8 in which the latch 7 disengages from the striker S to hold the door D open to a full-latch position in FIGS. 6, 10, 11 in which the latch 7 fully engages with the striker S via a half-latch position in FIG. 9 in which the latch 7 slightly engages with the striker S. In the following description, "open position", "half-latch position" and "full-latch position" of the latch 7 will be mentioned as "open state", "half-latch state" and "full-latch state" of the latch mechanism if required.

Figure 7:
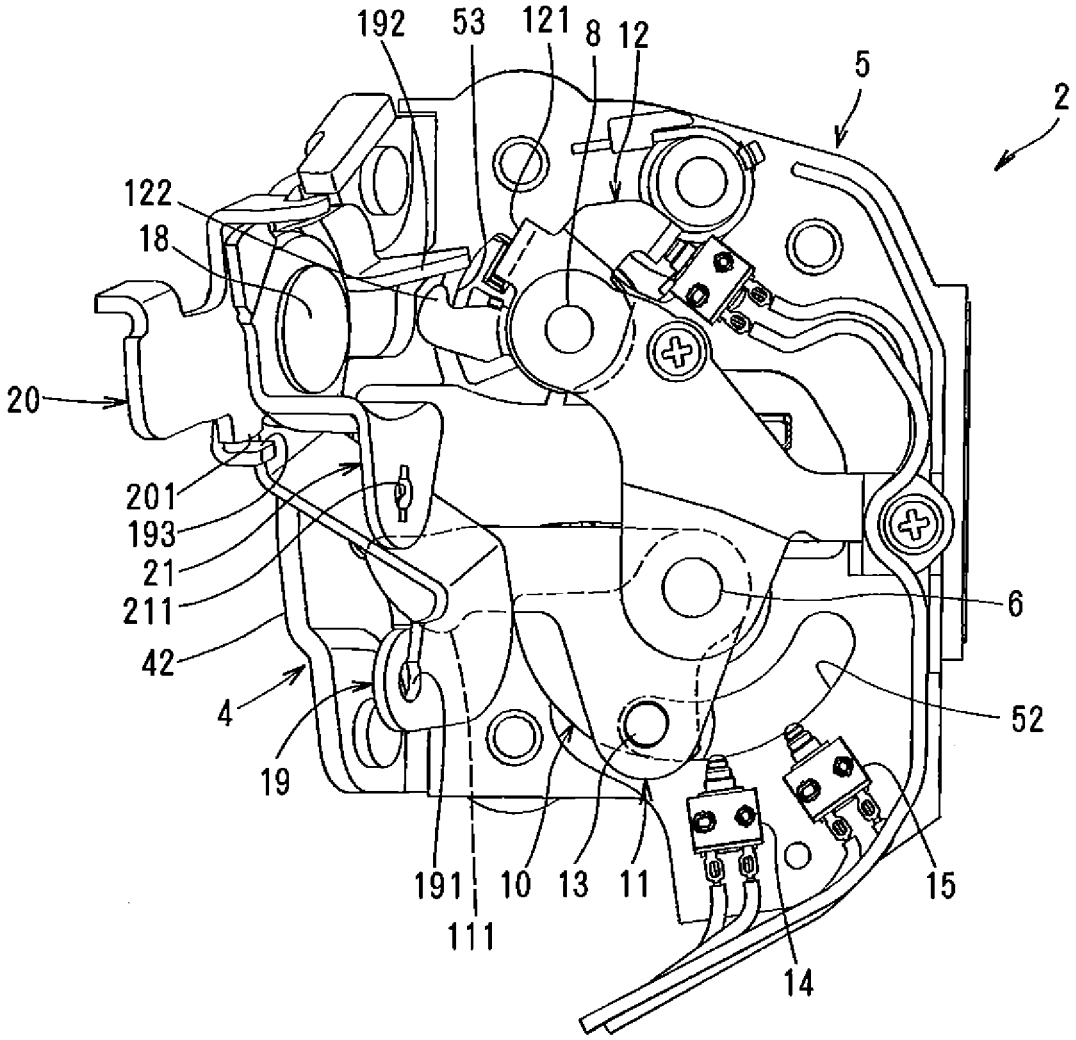
FIG. 7 is a side elevational view of the latch unit seen from the back.

In FIG. 7, on the front surface of the housing 5, there are a detecting lever 10 and a latch lever 11 which turns with the latch 7 via the latch shaft 6, and an opening lever 12 which turns with the ratchet 9 via the ratchet shaft 8.

The latch lever 11 which turns with the latch 7 is directed downward in FIG. 8 when the latch 7 is in the open position; is directed forward and obliquely downward when the latch 7 is in the half-latch position; and is directed forward in FIG. 10 when the latch 7 is in the full-latch position. An actuating portion 111 at the end of the latch lever 11 goes out of a moving path of a closing portion 381 of a closing lever 38 which is a part of a planetary gear mechanism 33 when the latch 7 is in the open position, and comes into the moving path of the closing portion 381 when the latch 7 turns to the half-latch position.

A connecting shaft 13 which is directed backward is fixed on a rotary surface of the detecting lever 10 and the latch lever 11. The connecting shaft 13 passes through an arcuate hole 52 around the latch shaft 6 of the housing 5 and is fixed to an arm 73 of the latch 7 enabling the detecting lever 10 to turn with the latch lever 11 and latch 7.

A first arm 121 directed rearward in the opening lever 12 passes through an acuate hole 53 around the ratchet shaft 5 of the housing 5 and engages with the ratchet 9. The operating lever 12 turns together with the ratchet 9.

In FIG. 7, the half-latch position and full-latch position are detected by a half-latch detecting switch 14 and a full-latch detecting switch 15 on the front surface of the housing 5. A detected signal is transmitted to a control circuit (not shown) to trigger stop and drive of a motor 321 as a power source of the closer-release unit 3.

The ratchet 9 is forced with the opening lever 12 in an engagement direction or counterclockwise in FIGS. 6 and 8-15 anytime by a spring 17 on the front surface of the housing 5; is in contact with the outer circumference of the latch 7 when the latch 7 is in the open position in FIG. 8; and is in contact with the half-latch engagement portion 72 of the latch 7 when the latch 7 is in the half-latch position in FIG. 9 thereby preventing the latch 7 from turning in an opening direction from the half-latch position in an opening direction or clockwise in FIGS. 9 and 10. When the latch 7 is in the full-latch position in FIG. 10, the ratchet 9 is in contact with the full-latch engagement portion 71 of the latch 7 thereby preventing the latch 7 from turning in the opening direction from the full-latch position.

When the ratchet 9 engages with the full-latch engagement portion 71 or half-latch engagement portion 72 of the latch 7, the locking mechanism 101 of the motion-connecting section 100 is unlocked. The outside handle OH or inside handle IH is operated to open the door D, and the ratchet 9 turns in the releasing direction or clockwise in FIGS. 6 and 8-15 against the force of the spring 17 via various elements and moves to the releasing position in FIGS. 12 and 13 to leave the full-latch engagement portion 71 or half-latch engagement portion 72, so that the door D can be opened.

A release-input lever 19, a blocking lever 20 and an emergency lever 21 are pivotally mounted to a support surface of the cover plate 4 via a shaft 18 extending transversely of the vehicle.

To a connecting portion 191 at the lower part of the release input lever 19 is connected the rear end of the motion-transmitting member 505 which extends longitudinally of the vehicle in the door D. Hence, the outside handle OH or inside handle IH is operated to open the door D, so that the release input lever 19 swings against a force of a spring 23 from a neutral position in FIGS. 8-11 or counterclockwise in FIGS. 8-11 and turns to the release position in FIGS. 12 and 13 only when the locking mechanism 101 of the motion-connecting section 100 is in the unlocking state. When the release-input lever 19 turns to the release position, a releasing portion 192 at the rear end of the release-input lever 19 pushes down the upper end of a second arm 122 of the opening lever 12 to make the ratchet 9 turn in a releasing direction via the opening lever 12 thereby releasing the ratchet 9 from the full-latch engagement portion 71 or full-latch engagement portion 72, so that the door D can be opened.

The release input lever 19 is connected to the output lever 103 of the motion-connecting section 100. Thus, when the locking mechanism 101 is in the unlocking state, the release input lever swings in the releasing direction by door-opening motion of the outside handle OH or inside handle IH, but when the locking mechanism 101 is in the locking state, the release input lever 19 still stays in the neutral position and does move in the releasing direction even if the outside handle OH or inside handle IH is operated to open the door D.

The blocking lever 20 is held by the spring 23 in a blocking position in which a blocking portion 203 at the front end is directed forward in FIGS. 8-11. When the release-input lever 19 moves in the releasing direction to the release position in FIG. 14, a bent portion 193 of the release-input lever 19 comes in contact with a contact portion 201 upward. Hence, the blocking lever 20 turns to a canceling position in FIGS. 12-14 to which the blocking lever 20 turns at a certain angle counterclockwise from the blocking position.

When the blocking lever 20 is held in the blocking position in FIGS. 8-11, the blocking portion 203 prevents a sun gear 35 (later described) of the planetary gear mechanism 33 from turning counterclockwise. The blocking portion 203 moves to a canceling position in FIGS. 12-14 to get the sun gear 35 to turn free counterclockwise. Thus, when the blocking lever 20 is in the blocking position, reduced rotation of the planetary gear mechanism 33 can be transmitted to the latch 7, and when the blocking lever 20 is in the canceling position, reduced rotation of the planetary gear mechanism 33 is cut off and cannot be transmitted to the latch 7.

A connecting portion 211 at the lower end of the emergency lever 21 is connected to the rear end of the motion-transmitting member 502 extending longitudinally of the vehicle in the door D. The front end of the motion-transmitting member 502 is connected to the handle-connecting lever 102 of the motion-connecting section 100. The motion of the handle-connecting lever 102 is transmitted to the emergency lever 21 via the motion-transmitting member 502. Hence, the emergency lever 21 turns in the releasing direction or counterclockwise in FIGS. 8-11 from the neutral position in FIGS. 8-11 with door-opening operation of the outside handle OH or inside handle IH whether the locking mechanism 101 is in the unlocking state or locking state.

When the emergency lever 21 turns in the releasing direction, a contact portion 212 at the upper end of the emergency lever 21 comes in contact with a bent portion 202 of the blocking lever 20 upward, and the blocking lever 20 turns in the releasing direction against the spring 23. In this case, the release-input lever 19 is still held in the neutral position, and the ratchet 9 does not swing in the releasing direction. Thus, regardless of the state of the locking mechanism 101, the outside handle OH or inside handle IH is operated to open the door D, the blocking lever 20 moves to the canceling position thereby enabling closing action of the closer-release unit 3 to stop as described later.

Then, the closer-release unit 3 will be described.

In FIGS. 3-5, the closer-release unit 3 comprises a metal base member 31 fixed to a support surface 42 of the cover plate 4 of the latch unit 2 with two upper and lower rivets 25; a drive unit 32 disposed at the front part of the base member facing the outside of the vehicle and including an electric motor 321 and a reduction gear for reducing rotation of the motor 321, the planetary gear mechanism 33 disposed in the middle (between the latch 7 of the latch unit 2 and the drive unit 32) of the base member 31 at the front part facing the outside of the vehicle and meshing with an output gear 322 rotatable around a shaft transversely of the vehicle to supply a rotational force of the motor 321 to reduce rotation of the output gear 322; and a release-canceling mechanism including a first release-output lever 301 pivotally mounted to the base member 31, a second release-output lever 302 and a canceling lever 303.

The release-canceling mechanism is variable between a connecting state for transmitting releasing action (later described) of the planetary gear mechanism 33 by normal rotation of the motor 321 to the ratchet 9 and a disconnecting state for cutting off a motion-transmitting path between the planetary gear mechanism 33 and the ratchet 9.

The first release-output lever 301 is pivotally mounted to a base member 31 via a shaft 304 transversely extending of the vehicle, and comprises a releasing portion 301*a* extending downward and a vertical elongate hole 301*b* through which a floating pin 308 slides vertically. The first release-output lever 301 is forced clockwise in FIG. 5 by a spring 306; held in a neutral position in FIG. 5 when not actuated; and can turn in a releasing direction or counterclockwise in FIG. 5 from the neutral position against a force of the spring 306 based on releasing action of the planetary gear mechanism 33. (later described)

The second release-output lever 302 is pivotally mounted to the base member 31 via the same shaft with the first release-output lever 30, and a bent portion 302*a* at the upper end comes in contact with the first release-output lever 301 in a turning direction to move with the action of the first release-output lever 301 in the neutral direction.

To the upper end of the second release-output lever 302 is connected the rear end of a motion-transmitting member 503 extending longitudinally of the vehicle for transmitting to the handle-connecting lever 102 of the motion-connecting section 100 a releasing action or counterclockwise in FIG. 5 of the second release-output lever 302 from the neutral position in FIG. 5. In the second release-output lever 302 is formed an inverted L-shaped elongate hole 302*b* through which the floating pin 308 slides.

The canceling lever 303 is pivotally mounted to the base member 31 via a shaft 303*c* extending transversely of the vehicle and is held in a connecting position in FIG. 5 by a force of a spring 307. In an arm 303*a* which extends rearward of the canceling lever 303 is formed an elongate hole 303*b* through which the floating pin 308 slides. The elongate hole 303*b* overlaps an elongate hole 302*b* of the second release-output lever 302.

To an upper part of the canceling lever 303 is connected one end of a motion transmitting member 506 for transmitting motion of the door-cooperating lever 80 to the canceling lever 303. Thus, the canceling lever 303 is normally held in a connecting position for making the release-canceling mechanism connected, but when the door-cooperating lever 80 moves from the neutral position in a canceling direction, the canceling lever 303 turns with the movement of the door-cooperating lever 80 at a certain angle against a force of the spring 306 in a cutting-off direction or clockwise in FIG. 5 and moves t+o a cut-off position in FIG. 15 for making the release-canceling mechanism cut off. The motion of the door-cooperating lever 80 will be described later.

The floating pin 308 follows the canceling lever 303. When the canceling lever 303 is in the connecting position, the floating pin 308 is positioned at the lower part of the elongate hole 302*b* of the second release-output lever 302 in FIG. 8 and held in the connecting position in which the release-canceling mechanism is connected. When the canceling lever 303 moves to the cut-off position, the floating pin 308 is positioned in the upper part of the elongate hole 302*b* in FIG. 15 to make the release-canceling mechanism cut off.

When the canceling lever 303 and floating pin 308 are in the connecting position and when the release-canceling mechanism is in the connecting state, the motion-transmitting path is connected between the first release-output lever 301 and the second release-output lever 302. Thus, releasing motion of the first release-output lever 301 by releasing the planetary gear mechanism 33 (described later) is transmitted to the ratchet 9 via the floating pin 308, second release-output lever 302, motion-transmitting member 503, handle lever 102, output lever 103, motion-transmitting member 505, release-input lever 19 and opening lever 12. So, the ratchet 9 moves to the releasing position, so that the door D is opened.

When the canceling lever 303 and floating pin 308 move to the canceling position to put the release-canceling mechanism into the canceling state, the motion-transmitting path is cut off between the first release lever 301 and the second release lever 302. When the planetary gear mechanism 33 is released owing to electrical failures or other accidents, the first release-output lever 301 is held in the releasing position, so that the first release-output lever 301 and second release-output lever 302 cannot return to the neutral position. The ratchet 9 is held in the releasing position, so that the door D cannot be closed in the release-holding condition. However, the motion-transmitting path between the first release-output lever 301 and the second release-output lever 302 is cut off to make the release-holding condition canceled. By enabling the second release output lever 30 and release-input lever 19 to return to the neutral position and enabling the ratchet 9 to return to the engagement position while the release-output lever 301 still remains in the release position, the latch unit 2 can be engaged with the striker S to allow the door D to close.

When the canceling lever 303 is in the connecting position, the first and second release-output levers 301,302 are released, which is transmitted to the handle-connecting lever 102 of the motion-connecting section 100 via the motion-transmitting lever 503 to actuate the handle-connecting lever 102. When the locking mechanism 101 of the motion-connecting section 100 is in the unlocking state, the motion of the handle-connecting lever 102 is transmitted to the release-input lever 19 and front door latch FD via the output lever 103 and motion-transmitting members 504,504.

The planetary gear mechanism 33 provides a closing function for moving the latch mechanism of the latch unit 2 from the half-latch state to the full-latch state or moving the latch 7 from the half-latch position to the full-latch position and releasing function for releasing the ratchet 9 to enable the door to open.

In FIGS. 4 and 5, the planetary gear mechanism 33 comprises the sun gear 35 pivotally mounted to the base member 31 via a pivot shaft 34; a single planetary gear 36 which meshes with the sun gear 35 to revolve while it turns on its own axis: the closing lever 38 pivotally mounted via the pivot shaft 34 and pivotally mounted via a pivot shaft 37 with the planetary gear 36; and a sector gear 39 pivotally mounted via the pivot shaft 34 and having external teeth 391 which mesh with an output gear 322 and internal teeth 392 which mesh with the planetary gear 36.

In FIG. 8, the sun gear 35 has external teeth 351 which mesh with the planetary gear 36 on an outer circumference over approximately 170 degrees as a central angle θ1, and a cylindrical contact portion 352 is provided on a rotary surface on which the external teeth 351 are not formed.

In order to prevent the sun gear 35 from turning counterclockwise, the contact portion 352 can come in contact with the blocking portion 203 of the blocking lever 20. The sun gear 35 turns clockwise to enable the contact portion 352 to come in contact with a releasing portion 301*a* of the first release-output lever 301 to actuate the first release-output lever 301 in a releasing direction. That is to say, normally (where the blocking lever 20 is in a neutral state) the sun gear 35 can turn clockwise from a sun-gear neutral position in FIG. 5, but cannot turn counterclockwise from the sun-gear neutral position.

When the blocking lever 20 is in a blocking position in FIGS. 8-11, the blocking portion 203 of the blocking lever 20 is within a moving path of the contact portion 352 and comes in contact with the contact portion 352 when the sun gear 35 turns counterclockwise slightly from FIG. 8 to block counterclockwise turning of the sun gear 35. When the blocking lever 20 is in a canceling position in FIGS. 12 and 13, the blocking portion 203 of the blocking lever 20 goes out of the moving path of the contact portion 352 to make the sun gear 35 turn freely counterclockwise.

When the planetary gear mechanism 33 does not work in the neutral state in FIG. 8, the sun gear 35 is set in a neutral position where the external teeth 351 is the lowest and the contact portion 352 is the highest.

In this embodiment, the external teeth 351 is formed on the outer circumference over 170 degrees as the central angle θ1. The present invention is not limited thereto, but may be 90 to 180 degrees as the central angle of the sun gear 35.

In FIG. 8, the closing lever 38 comprises a closing portion 381 at one end of an arm closer to the latch 7 of the latch unit 2 than the pivot shaft 34, and a pivot portion 382 at the other end closer to the pivot shaft 34 than the latch 7. The closing portion 381 is capable of coming in contact with an actuating portion 111 of the latch lever 11, and the pivot portion 382 for pivotally mounting the planetary gear 36 via the pivot shaft 37.

In the neutral state of the planetary gear mechanism 33 in FIG. 8, the closing lever 38 is forced counterclockwise by a spring 40 which is mounted at one end to the closing lever 38 and at the other end to the base member 31 and is held in the neutral position where the closing portion 381 is directed rearward and obliquely downward and the pivot portion 382 is directed forward and obliquely downward or toward the output gear 322. Hence, when the closing lever 38 is in the neutral position, the planetary gear 36 faces the output gear 322 while they hold the external teeth 391 and internal teeth 392 of the sector gear 39 therebetween. When the planetary gear mechanism 33 is in the neutral state, the external teeth 391 and internal teeth 392 of the sector gear 39 are held between the planetary gear 36 and the output gear 322 facing each other, thereby preventing the sector gear 39 from loosening.

Figure 16:
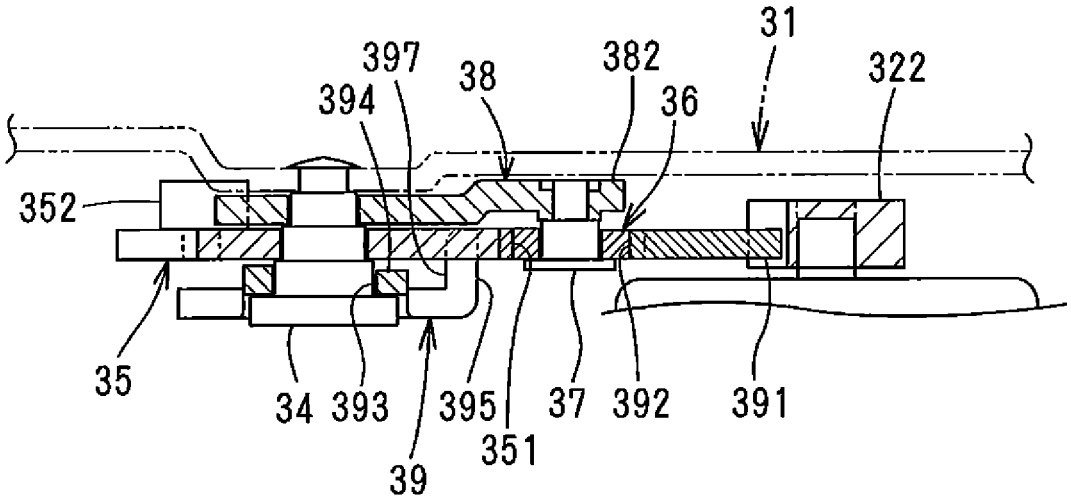
FIG. 16 is an enlarged sectional view taken along the line XVI-XVI in FIG. 5.

In FIG. 8, the external teeth 391 and internal teeth 392 of the sector gear 39 are formed on the outer and inner circumferences of a sector over 80 degrees as a central angle respectively. The sector gear 39 has a support portion 394 having an axial hole 393 in which the pivot shaft 34 fits, and an opening 395 in which the planetary gear 36 meshes with the internal teeth 392 in FIGS. 4 and 16. The planetary gear 36 revolves in the opening 395 while turning on its own axis.

In the neutral state of the planetary gear mechanism 33, the sector gear 39 is set in the ring-gear neutral position where the external teeth 391 is directed forward or in a direction opposite the latch 7. The ring-gear neutral position of the sector gear 39 is detected by a detecting switch 62 under the sector gear 39 in FIG. 5.

On upper and lower bridges 396 between the support portion 394 and the circumferential portion having the external and internal teeth 391,392 of the sector gear 39, a step 397 is formed such that the circumferential portion is closer to the surface of the base member 31 than the support portion 394. Hence, in FIG. 16, the closing lever 38, the sun gear 35 and the sector gear 39 overlap axially of the pivot shaft 34 on the base member 31. Thus, the external teeth 351 of the sun gear 35, the planetary gear 36, the external teeth 391 and internal teeth 392 of the sector gear 39 and the output gear 322 are positioned side by side approximately in the same surface thereby making the planetary gear mechanism 33 thinner along an axis of the pivot shaft 34 and achieving more smooth operation.

In FIG. 8, when the blocking lever 20 and planetary gear mechanism 33 are in the blocking position and in the neutral state respectively, the sector gear 39 turns in a closing direction or clockwise around the pivot shaft 34 with rotation of the motor 321, and counterclockwise rotation of the sun gear 35 is blocked by the blocking portion 203 of the blocking lever 20, so that the planetary gear 36 revolves clockwise while turning on its own axis. Hence, the closing lever 38 follows orbiting of the planetary gear 36 and swings in a closing direction or clockwise around the pivot shaft 34 slower than the sector gear 39, so that the closing lever 38 turns to the closing position where the closing portion 381 faces the top in FIG. 10.

In FIG. 8, when the blocking lever 20 and planetary gear mechanism 33 are in the blocking position and neutral state respectively, the sector gear 39 turns in a releasing direction or counterclockwise around the pivot shaft 34 with reverse rotation of the motor 321, so that the closing lever 38 is forced counterclockwise by the spring 40 and held in the neutral position. The planetary gear 36 pivotally connected to the closing lever 38 turns on its own axis counterclockwise without orbiting. Hence, the sun gear 35 turns clockwise or in a releasing direction based on turning of the planetary gear 36, so that the contact portion 352 comes in contact with the releasing portion 301*a* of the first release-output lever 301 to actuate the first release-output lever 301 in a releasing direction.

When the canceling lever 303 is in the connecting position, the releasing action of the first release-output lever 301 is transmitted to the handle-connecting lever 102 of the motion-connecting section 100 via the floating pin 308, second release-output lever 302, and motion-transmitting member 503. Furthermore, when the locking mechanism 101 of the motion-connecting section 100 is in the unlocking state, the releasing action of the handle-connecting lever 102 is transmitted to the ratchet 7 via the output lever 103, motion-transmitting member 505, release input lever 19 and opening lever 12. Hence, the ratchet 9 disengages from the latch 7 to enable the door D to open. After the releasing action of the latch mechanism finishes, the motor 321 is reversely controlled and the planetary gear mechanism 33 returns to the neutral state.

As mentioned above, in the planetary gear mechanism 33 in this embodiment, the external teeth 91 and internal teeth 392 are formed on the sector gear 39, and the single planetary gear 36 which meshes with the internal teeth 392 is disposed within the opening 395 of the sector gear 39. The single planetary gear 36 revolves and turns on its own axis in the opening 395 inner than the circumference of the sector gear 39, thereby making the planetary gear mechanism 33 smaller circumferentially.

The external teeth 391 and internal teeth 392 are formed on the outer and inner circumferences of the sector respectively over less than 180 degrees as a central angle, and the external teeth 351 are formed on the outer circumference of the sector over less than 180 degrees as a central angle, thereby making the sector gear 39 and sun gear 35 smaller and making the planetary gear mechanism 33 smaller.

The single planetary gear 36 is pivotally mounted directly on the pivot portion 382 of the closing lever 38, thereby reducing the number of parts and actuating the closing lever 38 more smoothly.

When the sector gear 39 is in the neutral position, the external teeth 391 and internal teeth 392 are more distant than the pivot shaft 34 from the latch 7, so that the external teeth 391 and internal teeth 392 of the sector gear 39 do not exist between the latch 7 and the pivot shaft 34 of the planetary gear mechanism 33 thereby enabling the pivot shaft 34 of the planetary gear mechanism 33 to come closer to the latch 7 and making the door latch system 1 smaller.

In this embodiment, the electric drive mechanism according to the present invention comprises the motor 321, output gear 322 and planetary gear mechanism 33 as reduction device, but is not limited thereto. As far as a motor is provided, the reduction mechanism may be omitted or the reduction device may comprise a worm gear and a spur gear.

Figure 17:
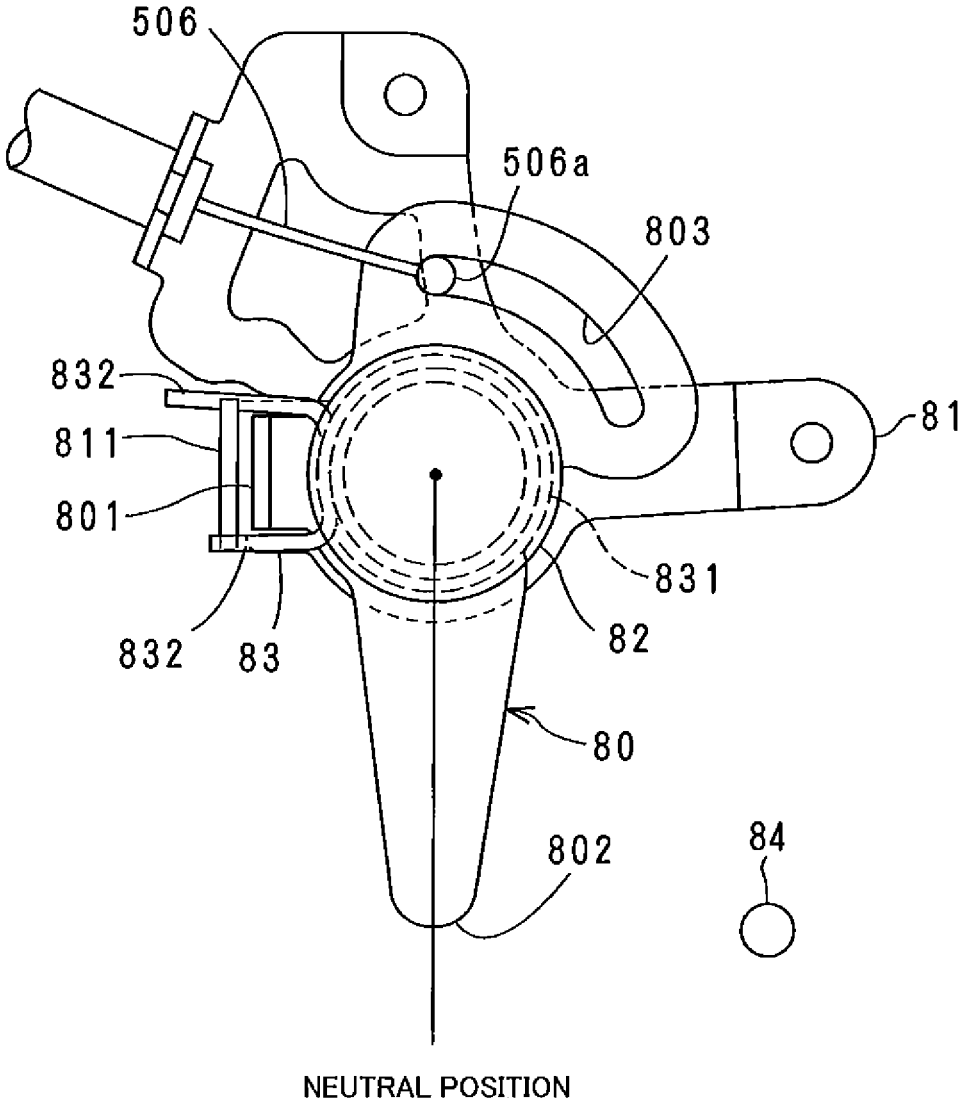
FIG. 17 is a top plan view of a door-cooperating lever.

The door-cooperating lever 80 is pivotally mounted via a vertical pivot shaft 82 to a base bracket 81 in FIG. 17 fixed to the front lower part of the door D, specifically, to a lower roller bracket (not shown) fixed to the front lower part of the door D and supported on the lower guide rail LR to move longitudinally of the vehicle, and is held in a neutral position in FIG. 17 anytime by a spring 83 wound on the pivot shaft 82. The door-cooperating lever 80 is capable of turning in a canceling direction or clockwise in FIG. 17 and in a non-canceling direction or counterclockwise in FIG. 17. In FIGS. 1 and 2, for easier understanding of the arrangement of the door-cooperating lever 80, the door-cooperating lever 80 is shown to turn around a shaft extending transversely of the vehicle.

In FIG. 17, a coil 831 of the spring 83 is wound on the pivot shaft 82 and a bent portion 801 of the door-cooperating lever 80 is held between ends 832 and 832. The ends 832,832 engage with an engagement portion 811 of the base bracket 81. Hence, the door-cooperating lever 80 is elastically held in the neutral position.

The door-cooperating lever 80 comprises an arm 802 and an elongate hole 803. The arm 802 extends toward the vehicle body or toward the lower part in FIG. 17, and is capable of coming in contact with the contact pin 84 fixed to the vehicle body or lower guide rail LR from an opening direction of the door D. The elongate hole 803 is coupled to the other end 506*a* of the motion-transmitting member 506 one end of which is coupled to the canceling lever 303. The other end 506*a* of the motion-transmitting member 506 pulls the motion-transmitting member 506 by contacting the edge of an elongate hole 803 when the door-cooperating lever 80 turns from the neutral position in a canceling direction, but when the door-cooperating lever 80 turns from the neutral position in an non-canceling direction, the other end 506*a* relatively moves or merely slides in an arc of the elongate hole 803. Hence, non-canceling turning of the door-cooperating lever 80 is not transmitted to the motion-transmitting member 506.

Figure 18:
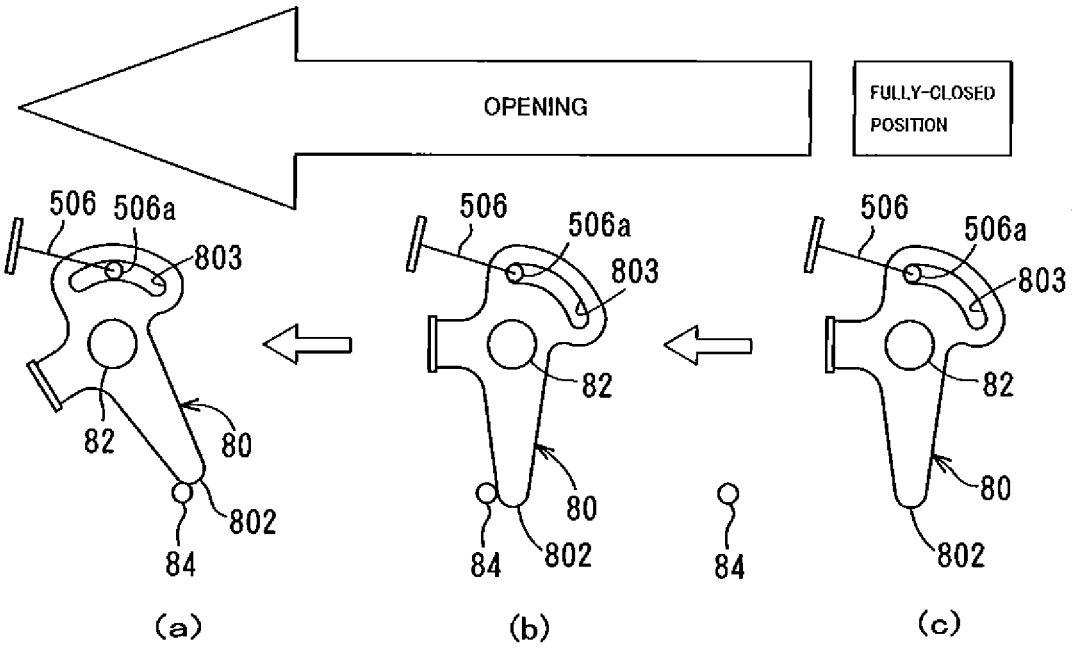
FIG. 18 is a view for illustrating motion of the door-cooperating lever when the door opens.

When the door D is in the fully-closed position, in FIG. 18(*c*), the contact pin 84 is positioned at the back of the door-cooperating lever 80 or in opening direction side. In this situation, the ratchet 9 is actuated in a releasing direction by the drive unit 32 to allow the latch unit 2 to disengage from the striker S. The door D moves from the fully-closed position in an opening direction and reaches to a certain position prior to the fully-closed position. In FIG. 18(*b*), the arm 802 of the door-cooperating lever 80 comes in contact with the contact pin 84. Thus, in FIG. 18(*a*), the door-cooperating lever 80 turns at a certain angle from the neutral position counterclockwise against the spring 83. The door D further moves in an opening direction and passes a certain position. The arm 802 goes over the contact pin 84 and the door-cooperating lever 80 returns to the neutral position again by the spring 83. In this case, even if the door-cooperating lever 80 turns in the non-canceling direction, the rotation is not transmitted to the motion-transmitting member 506 or canceling lever 303.

Figure 19:
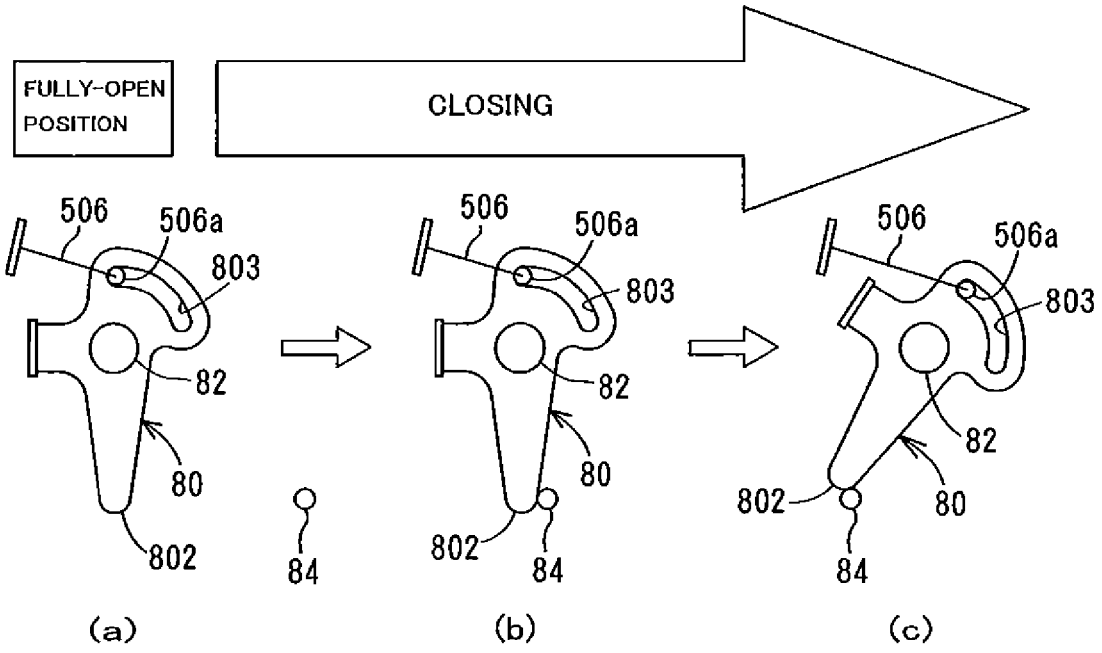
FIG. 19 is a view for illustrating motion of the door-cooperating lever when the door closes.

When the door D is in the fully-open position, in FIG. 19(*a*), the contact pin 84 is positioned in front of the door-cooperating lever 80 or in a closing-direction side. In this situation, the door D moves in a closing direction from the fully-open position, and reaches to a certain position before the closed position. In FIG. 19(*b*), the arm 802 of the door-cooperating lever 80 comes in contact with the contact pin 84. Thus, in FIG. 19(*c*), the door-cooperating lever 80 turns at a certain angle clockwise or in a canceling direction from the neutral position against the spring 83. The door D further moves in a closing direction and passes a certain position. The arm 802 goes over the contact pin 84 and the door-cooperating lever 80 returns to the neutral position again by the spring 83.

The door-cooperating lever 80 turns in the canceling direction, and the rotation is transmitted to the canceling lever 303 via the motion-transmitting member 506. The canceling lever 303 and floating pin 308 are moved to the canceling position to change the release-canceling mechanism to the canceling state. Thus, when the door D is opened, the door D moves in a closing direction to cancel the release-holding state without special operation by the passenger, so that the door D can be closed.

The motion of the door latch system will be described with respect to FIGS. 8-19.

Closing Motion

In FIG. 8, when the door D is open or when all elements of the closer-release unit 3 is in the neutral state while the latch unit 2 is in the open state, the door D is closed to an ajar position and the striker S engages with the latch 7.

The latch 7 turns from the open position to the half-latch position, and the ratchet 9 engages with the half-latch engagement portion 72 of the latch 7. The actuating portion 111 of the latch lever 11 comes into the moving path of the closing portion 381 of the closing lever 38 by turning the latch 7 to the half-latch position.

The half-latch detecting switch 14 detects that the latch 7 turns to the half-latch position, and the motor 321 is normally controlled by the control circuit. Thus, in a half-latch state in FIG. 9, the output gear 322 turns counterclockwise as shown by an arrow, and the sector gear 39 swings around the pivot shaft 34 in a closing direction as shown by an arrow. In this case, the blocking lever 20 is in the blocking position where the blocking portion 203 can come in contact with the contact portion 352 of the sun gear 35. Hence, after the sun gear 35 swings slightly counterclockwise, the contact portion 352 comes in contact with the blocking portion 203, and the counterclockwise swinging of the sun gear 35 is blocked. Thus, the planetary gear 36 within the opening 395 of the sector gear 39 revolves while turning on its own axis clockwise.

The closing lever 38 swings clockwise in the closing direction as shown by an arrow against the force of the spring 40 with clockwise orbiting of the planetary gear 36. The closing lever 381 moves upward and pushes up the actuating portion 111 of the latch lever 11 to allow the latch lever 11 to swing counterclockwise. Thus, in FIG. 10, the latch 7 swings from the half-latch position to the full-latch position. The full-latch detecting switch 15 detects the full-latch position of the latch 15. Immediately after the motor 321 stops by the control circuit, it reverses.

The motor 321 reverses, and the sector gear 39 reverses counterclockwise. The planetary gear 36 revolves while turning on its own axis counterclockwise. With orbiting of the planetary gear 36, the closing lever 38 reverses by counterclockwise force of the spring 40 and returns to the neutral position in FIG. 11. When the detecting switch 62 detects the neutral position of the sector gear 39, and the motor 321 stops. The planetary gear mechanism 33 returns to the neutral state before operation, and a series of closing actions are over.

Canceling Action for Breaking the Closing Action

On the way from the half-latch state in FIG. 9 to the full-latch state in FIG. 10, for example, a foreign object is held between the door D and an entrance of the vehicle body. If it is necessary to stop the closing action, the outside handle OH or inside handle IH is operated to open the door D to prevent the foreign object to be held therebetween.

That is to say, when the locking mechanism 101 of the motion-connecting section 100 is in the unlocking state, the motor 321 stops by door-opening action of the outside handle OH or inside handle IH. Simultaneously, in FIG. 12, the release-input lever 19 acts in the releasing direction and pushes down the second arm 122 of the opening lever 12. The ratchet 9 is released with the opening lever 12. The bent portion 193 comes in contact with the contact portion 201 of the blocking lever 20 to allow the blocking lever 20 to swing to the canceling position against the spring 23.

Figure 13:
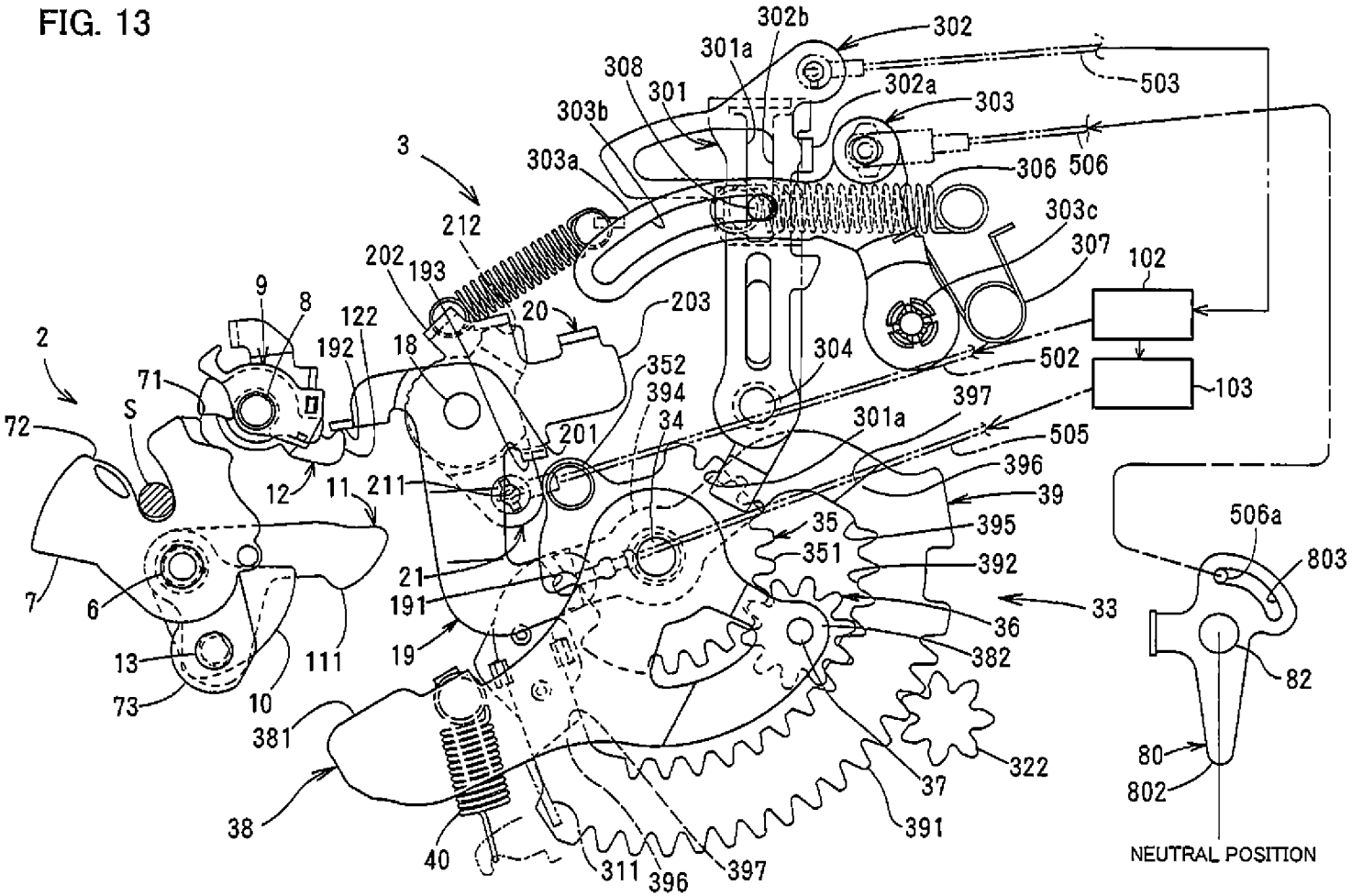
FIG. 13 is a front elevational view of the door latch system after the closing action is canceled.

The blocking lever 20 moves to the canceling position, and the blocking portion 203 goes out of the moving path of the contact portion 352 of the sun gear 35 to make the sun gear 35 turn freely counterclockwise. In FIG. 13, the closing lever 38 reverses to the neutral position by the force of the spring 40 to enable the latch 7 to swing to the opening position, so that the door D can be opened thereby keeping the foreign object from being held between the door D and the entrance and enhancing security.

After keeping the foreign object from being held, door-opening action of the outside handle OH or inside handle IH stops, and the motor 321 reverses.

The sector gear 39 swings toward the ring-gear neutral position, and the planetary gear 36 revolves while turning on its own axis. The sun gear 35 returns to the sun-gear neutral position in FIGS. 8 and 9. A series of canceling actions are over.

When the locking mechanism 101 of the motion-connecting section 100 is in the locking state, door-opening action of the outside handle OH or inside handle IH is not transmitted to the release-input lever 19, but transmitted to the emergency lever 21. Hence, the releasing action of the emergency lever 21 swings the blocking lever 20 to the canceling position, and the closing action stops similar to the above.

Releasing Action

In the full-latch state in FIG. 11, when a switch in the vehicle or a wireless switch is operated to open the door D, the motor 321 reverses. Hence, the sector gear 39 turns around the pivot shaft 34 in the releasing direction or counterclockwise, but the planetary gear 36 is held in the neutral position and is pivotally mounted to the closing lever 38 and turns on its own axis counterclockwise without orbiting. According to rotation of the planetary gear 36, the sun gear 35 turns at a certain angle in the releasing direction from the sun-gear neutral position. Hence, in FIG. 14, as the sun gear 35 turns, the contact portion 352 of the sun gear 35 comes in contact with the releasing portion 301*a* of the first release-output lever 301 and moves the first release-output lever 301 in the releasing direction.

When the canceling lever 303 is in the connecting position, the releasing action of the first release-output lever 301 is transmitted to the second release-output lever 302 via the floating pin 308, and the releasing action of the second release-output lever 302 is transmitted to the handle-connecting lever 102 of the motion-connecting section 100 via the motion-transmitting member 503. The releasing action of the handle-connecting lever 102 is transmitted to the release-input lever 19 via the output lever 103 and motion-transmitting member 505 when the locking mechanism 101 of the motion-connecting section 100 is in the unlocking state. Hence, in FIG. 14, the ratchet 9 disengages from the latch to enable the door D to open.

Release-Canceling Action for Canceling the Release-Holding State

Figure 14:
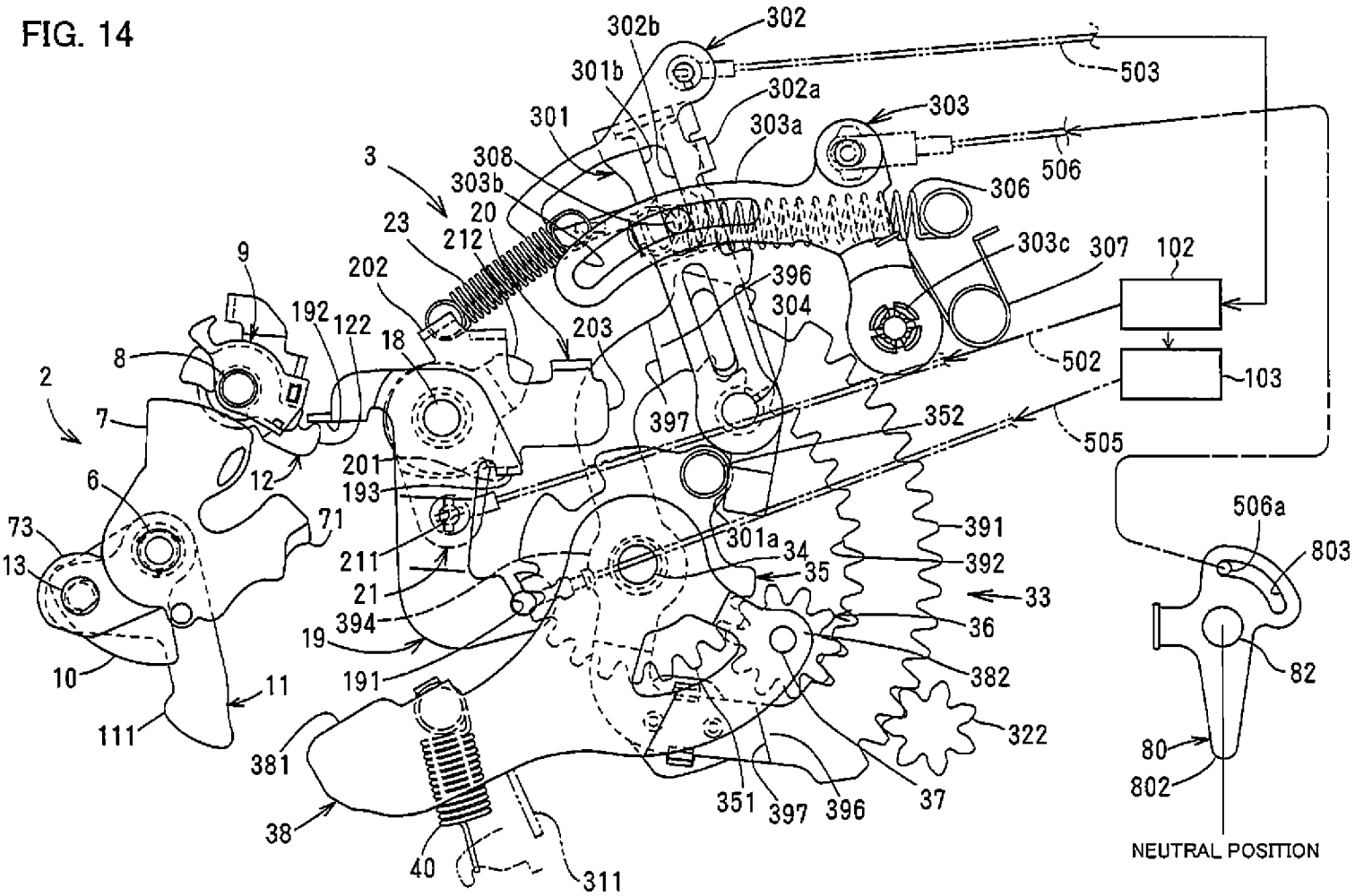
FIG. 14 is a front elevational view of the door latch system during a releasing action.

In FIG. 14, the sector gear 39 moves in the releasing direction from the ring-gear neutral position. The sector gear 39 stops in a releasing position by electrical failures or other causes to disable it to return to the ring-gear neutral position. The contact portion 352 of the sun gear 35 is still in contact with the releasing portion 301*a* of the first release-output lever 301 to cause release-holding state where the first release-output lever 301 and second release-output lever 302 are held in the releasing position. Hence, even if one try to close the door D, the ratchet 7 still remains in the releasing state and does not engage with the latch 7, so that the door D cannot be closed.

However, in this embodiment, even if the release-holding state occurs, the release-holding state is canceled by general operation for closing the door D in the fully-open position, so that the door D can be closed.

Figure 15:
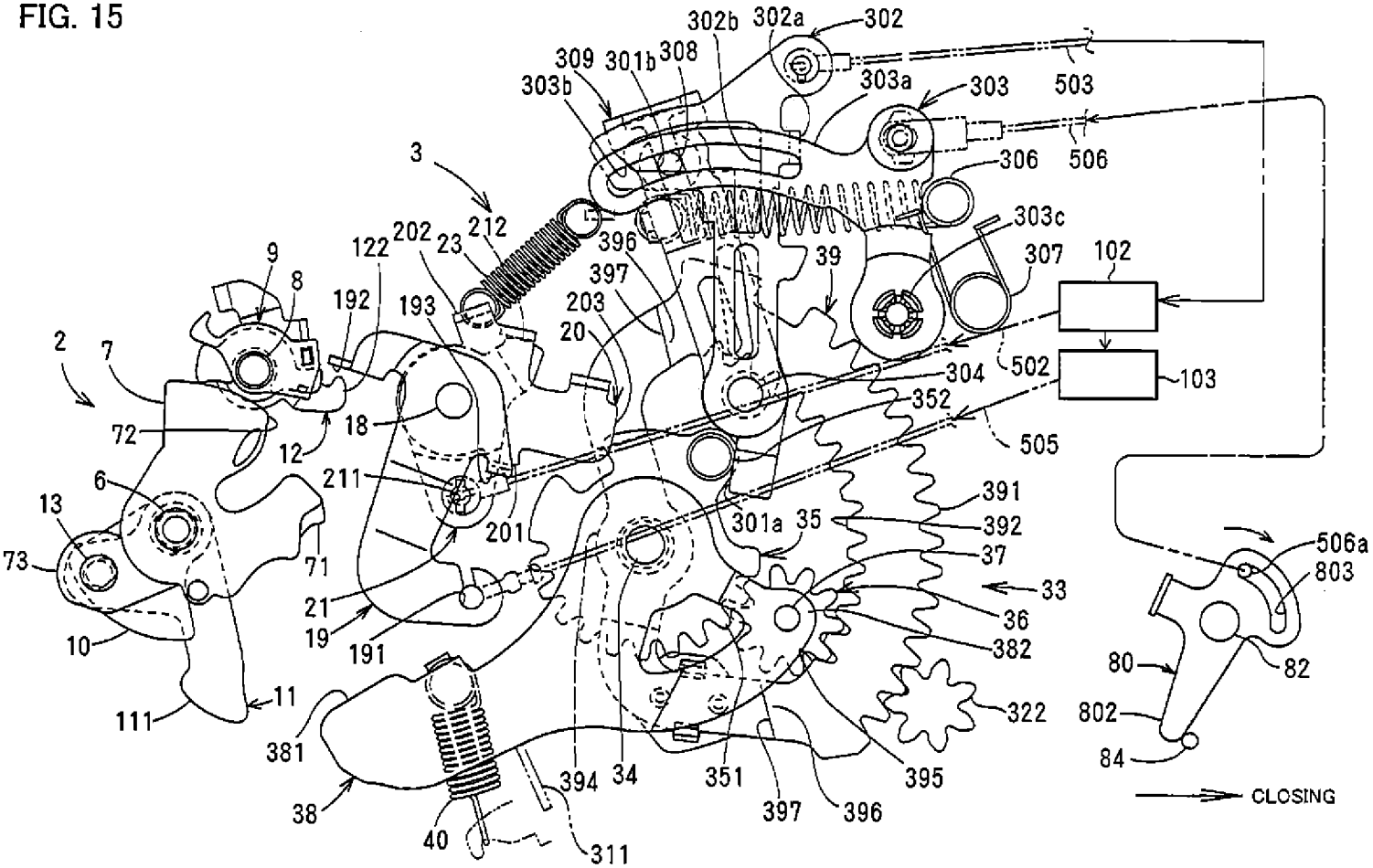
FIG. 15 is a front elevational view of the door latch system in which the releasing action is canceled.

In the release-holding state in FIG. 14, the door D moves for closing from the fully-open position and reaches to a certain position. In FIG. 15 and FIG. 19C, the arm 802 of the door-cooperating lever 80 comes in contact with the contact pin 84 from the closing direction, and the spring 83 turns in the canceling direction from the neutral position against the force of the spring 83. The canceling action is transmitted to the canceling lever 303 via the motion-transmitting member 506. Thus, in FIG. 15, the canceling lever 303 moves to a cut-off position against the force of the spring 307. The floating pin 308 follows the motion of the canceling lever 303 and moves to an upper cut-off position of the elongate hole 302*a* of the second release-output lever 302. A motion-transmitting path between the first release-output lever 301 and second release-output lever 302 is cut off to enable the second release-output lever 302 to move to the neutral position. Thus, the second release-output lever 302 held in the releasing position returns to the neutral position while the first release-output lever 301 remains, enabling the release input lever 10 and opening lever 12 to return to the neutral position and enabling the ratchet 9 to return to the engagement position. In this state, when the door D is closed, the striker S engages with the latch 7 in the fully-closed position of the door D, and the ratchet 9 engages with the full-latch engagement portion 71 of the latch 7, so that the door D can be held in the fully-closed position.

After the door D passes a certain position, the arm 802 of the door-cooperating lever 80 goes over the contact pin 84 and returns to the neutral position by the force of the spring 83. When the sector gear 39 returns to the ring-gear neutral position with solution of the electrical failures, the canceling lever 303 returns to the connecting position from the cut-off position by the force of the spring 307.

As mentioned above, ordinary operation in which the door D moves for closing enables the release-holding state to be canceled. Even if release-holding state occurs, the door D can be closed securely any time without special operation by the passenger.

Another Embodiment

FIGS. 20 to 23 illustrate another embodiment of a release-canceling mechanism. In the embodiment, when a door-co-operating lever 80 turns from a neutral position in a releasing direction with closing motion of the door D, the releasing turning is transmitted to a floating pin 308 in the release-holding state, but is not transmitted to the floating pin 308 in a neutral state where the first and second release-output levers 301,302 are in a neutral position.

Figure 20:
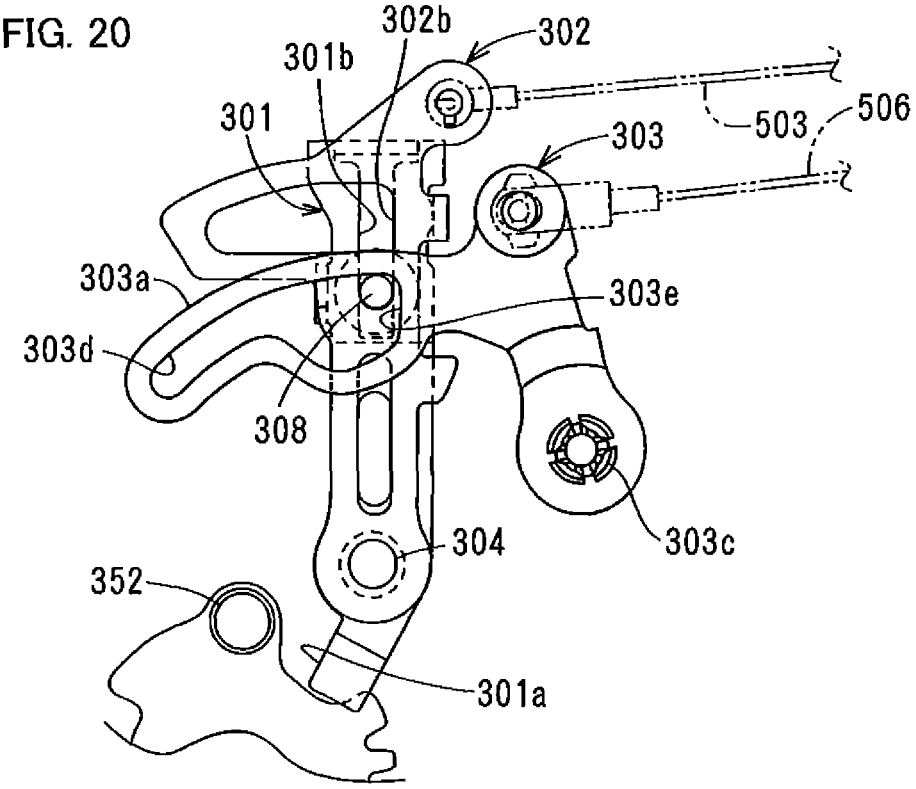
FIG. 20 is a front elevational view of a release-canceling mechanism in a neutral state in another embodiment.

Specifically, the elongate hole 303*b* of the canceling lever 303 in the foregoing embodiment is replaced with an elongate hole 30*d* in FIGS. 20 to 23. In the elongate hole 303*d*, a front width (right side in FIGS. 20-23) is larger than a rear width. In FIG. 20, when the first and second release-output levers 301, 302 are in a neutral position and a canceling lever 303 is in a connecting position, the floating pin 308 is positioned in an upper part of wider portion 303*e* to have a play with a lower edge of the wider portion 303*e* at the front of the elongate hole 303*a*.

Figure 21:
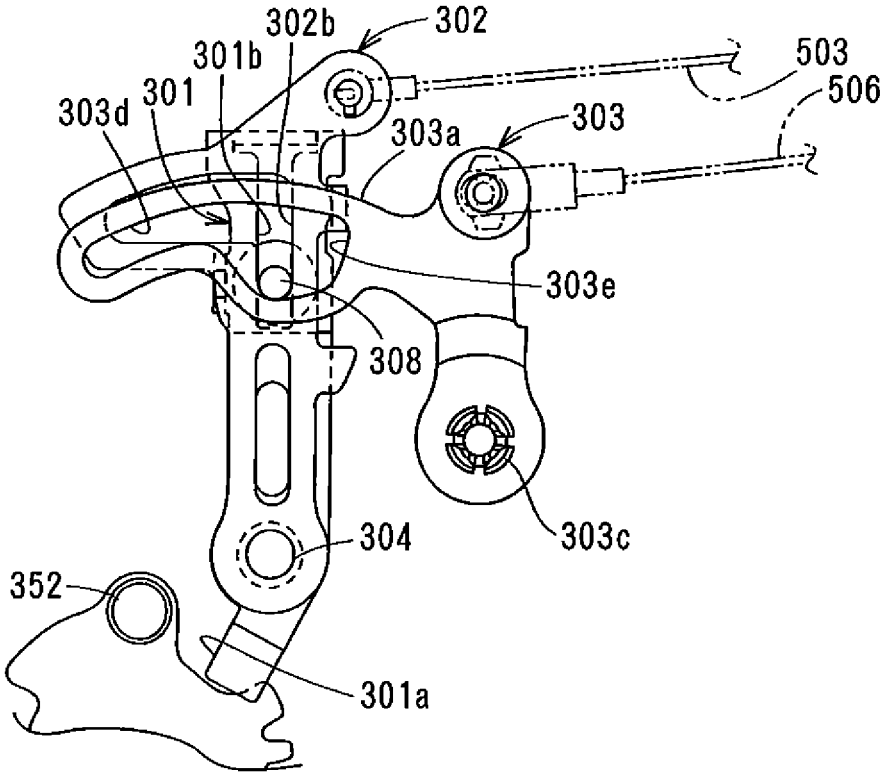
FIG. 21 is a front elevational view of the release-canceling mechanism when only a canceling lever moves to a canceling position.

In FIG. 20, with closing motion of the door D, a door-cooperating lever 80 turns in a releasing direction from the neutral position, and the canceling lever 303 moves from the connecting position to the cut-off position in FIG. 21. However, in this case, the lower edge of the wider portion 303*e* of the elongate hole 303*d* is not in contact with the floating pin 308, which does not move even if the canceling lever 303 moves from the connected portion to the cut-off position.

Figure 22:
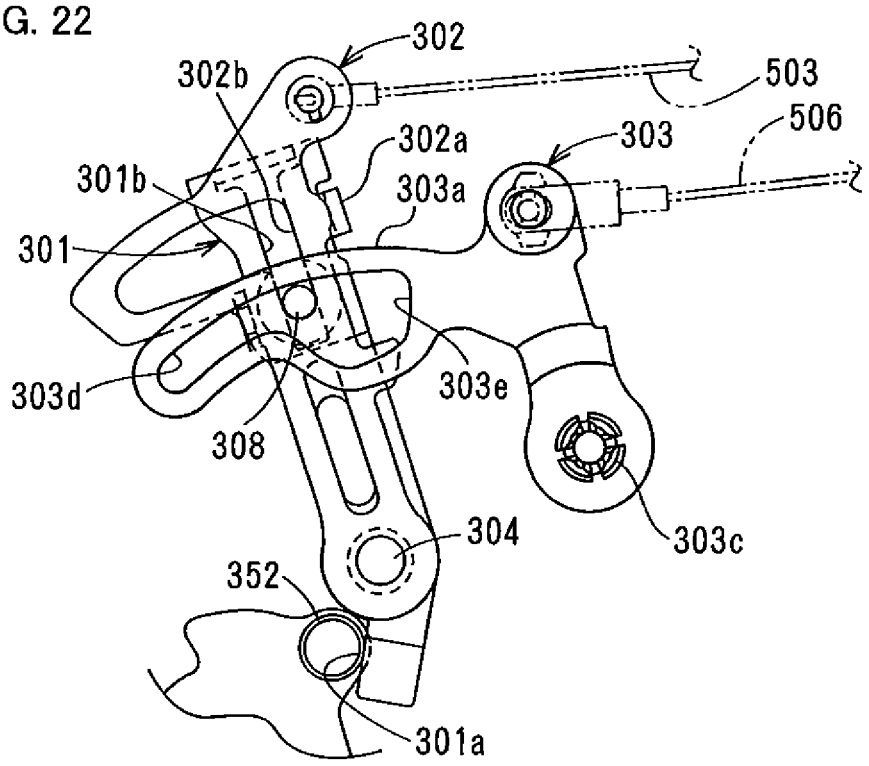
FIG. 22 is a front elevational view of the release-canceling mechanism in a release-holding state.
Figure 23:
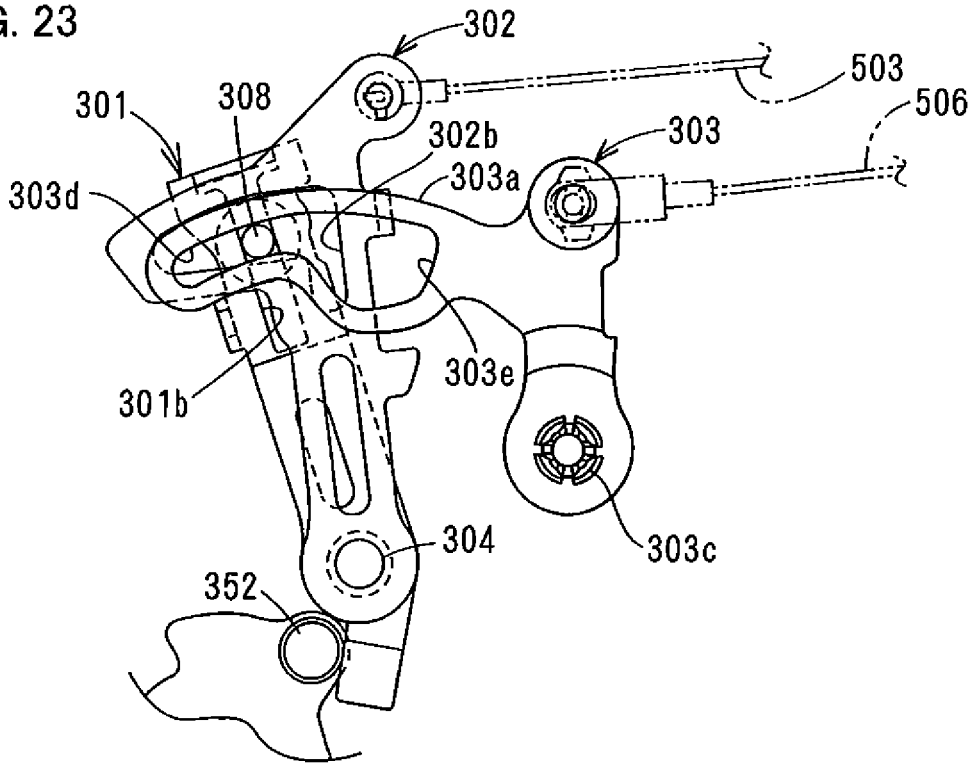
FIG. 23 is a front elevational view of the release-canceling mechanism when the canceling lever moves to a canceling position in the release-holding state.

In FIG. 22, in the release-holding state, the floating pin 308 is positioned at the rear side of the elongate hole 303*d* of the canceling lever 303. Thus, in this case, in FIG. 23, the canceling lever 303 moves to the canceling position and the floating pin 308 moves to the cut-off position together. Hence, a motion-transmitting path between the first release-output lever 301 and second release-output lever 302 is cut off to enable the ratchet 9 to return to an engagement position.

As mentioned above, in this embodiment, in a release-holding state, the canceling lever 303 moves to the cut-off position and the floating pin 308 moves to the cut-off position. When it is not release-holding state, the floating pin 308 does not follow the door-cooperating lever 80, thereby reducing the number of operating points except the release-holding state and achieving smooth operation.

The foregoing relates to the embodiments of the present invention. Various changes and modifications may be made without departing from the scope of claims, and any combination thereof is possible.

a) The closing portion 381 of the closing lever 38 is directly coupled to the latch 7 without the latch lever 11.
b) The base member 31 of the closer-release unit 3 is not fixed to the cover plate 4 of the latch unit 2, but is fixed to the housing 5 directly or via another element.
c) The structure for preventing the sun gear 35 from turning in other direction (counterclockwise in FIG. 5) may be a stopper of the base member 31 instead of the blocking lever 20.
d) The second release-output lever 302 is connected to the ratchet 9 directly or indirectly without the motion-connecting section 100.
e) Without the first and second release-output levers 301, 302, with one-direction turning of the sun gear 35

(clockwise in FIG. 5), the contact portion 352 can come in contact with the ratchet 9, opening lever 12 or release-input lever 19 enabling the ratchet 9 to release.

f) The first release-output lever 301 and second release-output lever 302 may be a unitary structure. In this case, a point for cutting off the motion-transmitting path for transmitting power of the electric drive mechanism to the ratchet 9 is provided on the way between the release-output lever and ratchet 9.

g) The door-cooperating lever 80 may slide vertically or longitudinally of the vehicle with opening/closing of the door D.

h) On the way from the fully-closed position to the open position or on the way from the fully-open position to the closed position, the door-cooperating lever 80 can move in a releasing direction from the neutral position by motion of the door D. In the former, the contact pin 84 is positioned at the back of the door-cooperating lever 80 or in an opening-direction side when the door D is in the fully-closed position. (preferably, positioned closer to the fully-closed position as well as the foregoing embodiments) In the latter, owing to both of the opening and closing motions of the door D, the release-canceling mechanism becomes the structure changeable to the cut-off state.

What is claimed is:

1. A vehicle door latch system comprising:

a latch positioned in a door to engage with a striker positioned in a vehicle body;

a ratchet that engages with the latch to hold the door closed and disengages from the latch to enable the door to open;

an electric drive mechanism that supplies power to move the ratchet from an engagement position where the ratchet engages with the latch to a release position where the ratchet disengages from the latch;

a door-cooperating lever that is capable of moving from a neutral position in a releasing direction for disengaging the ratchet from the latch to enable the door to open, owing to movement of the door on the way of the door from an open position to a closed position and/or from the closed position to the open position;

a release-canceling mechanism that is capable of switching a motion-transmitting path for transmitting power of the electric drive mechanism to the ratchet, from a connecting state where the motion transmitting path is connected, to a cut-off state where the motion transmitting path is cut off, by moving the door-cooperating lever from the neutral position in the releasing direction; and a contact pin, wherein the door-cooperating lever is positioned in one of the door and the vehicle body and the contact pin is positioned in the other of the door and the vehicle body, the door moving in a closing and/or opening direction and reaching to a certain position to allow the door-cooperating lever to come in contact with the contact pin, whereby the door-cooperating lever moves from the neutral position in the releasing direction and returning to the neutral position after it passes the certain position.

2. The vehicle door latch system of claim 1 wherein the door-cooperating lever is positioned in the door and the contact pin is positioned in the vehicle body.

3. The vehicle door latch system of claim 2 wherein the door-cooperating lever is pivotally mounted to the door, turns from the neutral position in the releasing direction by a spring and returns to the neutral position by the spring as the door passes the certain position.

4. The vehicle door latch system of claim 2 wherein the canceling lever does not cut off the motion-transmitting path even if the canceling lever moves to the cut-off position when the canceling lever is not in the release-holding state.

5. The vehicle door latch system of claim 1 wherein the door is a sliding door.

6. A vehicle door latch system comprising:

a latch positioned in one of a door and a vehicle body to engage with a striker positioned in the other of the door and the vehicle body;

a ratchet that engages with the latch to hold the door closed and disengages from the latch to enable the door to open;

an electric drive mechanism that supplies power to move the ratchet from an engagement position where the ratchet engages with the latch to a release position where the ratchet disengages from the latch;

a door-cooperating lever that is capable of moving from a neutral position in a releasing direction for disengaging the ratchet from the latch to enable the door to open, owing to movement of the door on the way of the door from an open position to a closed position and/or from the closed position to the open position;

a first release-output lever that moves in the releasing direction by coming in contact with a rotary member of the electric drive mechanism;

a canceling lever that moves from a connecting position where a motion-transmitting path for transmitting power from the electric drive mechanism to the ratchet is connected, to a cut-off position where the motion-transmitting path is cut off with motion of the door-cooperating lever; and a second release-output lever that moves with the first release-output lever in the releasing direction when the canceling lever is in the connecting position, wherein when the cancelling lever is in the cut-off position, the cancelling lever disconnects the first release-output lever from the second release-output lever, enabling the ratchet to engage with the latch to close the door.

* * * * *